US007128390B2

(12) United States Patent
Taniguchi

(10) Patent No.: US 7,128,390 B2
(45) Date of Patent: Oct. 31, 2006

(54) INK JET RECORDING APPARATUS

(75) Inventor: Hisashi Taniguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 10/914,241

(22) Filed: Aug. 10, 2004

(65) Prior Publication Data

US 2005/0041060 A1 Feb. 24, 2005

(30) Foreign Application Priority Data

Aug. 20, 2003 (JP) ..... 2003-296394

(51) Int. Cl.
*B41J 2/165* (2006.01)

(52) U.S. Cl. ..... 347/30

(58) Field of Classification Search ..... 347/22, 347/23, 29, 30
See application file for complete search history.

(56) References Cited

U.S. PATENT DOCUMENTS 4,359,744 A * 11/1982 Salmre ..... 347/3
5,389,961 A * 2/1995 Takagi ..... 347/29
6,631,973 B1 10/2003 Edamura
6,641,247 B1 * 11/2003 Ide et al. ..... 347/23

FOREIGN PATENT DOCUMENTS

JP 2001-63102 3/2001

* cited by examiner

*Primary Examiner*—Huan Tran
(74) *Attorney, Agent, or Firm*—Fitzpatrick, Cella, Harper & Scinto

(57) ABSTRACT

A suction recovery method of an ink jet recording apparatus which can realize a suction operation, in which suction recovery performance can be improved without enlarging a size of apparatus and a number of discharge ports can be held in a good state, is provided. When a negative pressure is generated in a cap which closes discharge ports of a recording head and ink is sucked from the discharge ports, the ink is sucked by a first suction step of sucking at a first, relatively low target negative pressure, which is sufficient to allow the ink which is not suitable for recording to flow from the discharge ports, and a second suction step of sucking at a second, relatively high target negative pressure necessary for sucking bubbles in the discharge ports (particularly, near the discharge ports).

12 Claims, 23 Drawing Sheets

INK JET RECORDING APPARATUS

BACKGROUND OF THE INVENTION

1. Field of the Invention

The invention relates to an ink jet recording apparatus for recording by discharging ink and a suction recovery method of the ink jet recording apparatus.

2. Related Background Art

An ink jet recording apparatus is an apparatus for recording by discharging ink from discharge ports of a recording means onto a recording material. The ink jet recording apparatus is used not only for general printing apparatuses but also for apparatuses such as a copying apparatus, a facsimile apparatus having a communication system, a word processor having a printing unit, and the like, and further, for an industrial recording apparatus combined as a hybrid apparatus with various processing apparatuses. In the ink jet recording apparatus for recording by discharging ink droplets from micro discharge ports, a viscosity thickening phenomenon of the ink, an increase in concentration of dye of the ink, fixing of the ink, or the like is caused by evaporation of volatilized ink components from the discharge ports of an ink jet recording head. By leaving for a long period of time, there is a case where bubbles are generated in a liquid chamber of the recording head. When the bubble is generated, the normal supplying operation of the ink is obstructed and, at the worst, the ink is not fed to the head and the recording operation is largely obstructed. To avoid such an inconvenience, there has widely been used a suction recovery method whereby a discharge port surface (face surface) of the recording head is capped, the inside of the cap is depressurized by a pump which has previously been provided in the printer, and the ink is emitted from the discharge port.

Kinds of pumps which are used for the suction recovery are mainly classified into a piston pump and a tube pump. FIG. 21 is an explanatory diagram showing a principle of the piston pump. FIG. 22 is an explanatory diagram showing a principle of the tube pump. FIG. 23 is a graph showing a negative pressure characteristics curve at the time of the suction operation in the tube pump. According to the method by the piston pump, as shown in FIG. 21, a depressurizing chamber 10 communicated with the cap is depressurized by moving a piston. In the piston pump, a suction amount and a suction pressure can be set by changing a movement amount of the piston. According to the method by the tube pump, as shown in FIG. 22, a negative pressure is generated in the cap by using a restoring force of a tube 121 stroked by a roller (pump roller) 120. According to the tube pump, a suction amount and a suction pressure can be arbitrarily set by changing a stroke amount and a stroke speed.

FIG. 23 shows a change in negative pressure with the elapse of time in the case where the inside of the cap is sucked by the tube pump. Referring to FIG. 23, it will be understood that although the suction pressure (negative pressure) increases with the elapse of time in an area A, the generation of the negative pressure by the pump and the elimination of the negative pressure by the emitted ink are balanced and a balance state is obtained in an area B. The negative pressure which provides the balance state is determined in dependence on a flow resistance of the head and ability of the pump upon suction. Ordinarily, the suction recovery operation is executed in the area A. Strictly speaking, suction recovery performance should be specified by the ink flow speed or flow rate. However, the ink flow speed changes with the elapse of time and it is not easy to measure them and quantitatively specify the suction recovery performance. Therefore, the suction recovery performance is generally managed by the suction pressure and the suction amount.

The suction pressure and the suction amount are determined on the basis of the maximum flow rate of the ink from an ink tank for supplying the ink to the recording head, a volume of an ink flow path from an ink supply port of the recording head to the discharge port of the recording head, and the like. When the suction amount is small, the recording head is not sufficiently filled with the ink and an inconvenience occurs. When the suction amount is large, the ink is wastefully consumed. If the bubbles are inserted into the ink flow path of the recording head because, for example, the ink tank is not attached, the empty consumed ink tank has been attached, or the like, it is necessary to remove the bubble by the suction recovery operation. At this time, when the suction pressure is too low, the bubble cannot be sucked, and when the suction pressure is too high, the ink flow speed from the discharge port of the recording head increases, the ink flow rate exceeds the maximum ink flow rate from the ink tank, and the bubbles instead of the ink are fetched from the ink supply port, so that an inconvenience occurs.

In the suction recovery using the tube pump, as disclosed in, for example, Japanese Patent Application Laid-Open No. 2001-063102, the following suction recovery operation is executed: the tube pump is continuously rotated, the inside of the cap is rapidly set to a target negative pressure, and after that, the driving/stop of the tube pump are repeated a plurality of number of times, thereby maintaining the inside of the cap toga value within a predetermined range near the target negative pressure so that the negative pressure curve in which the negative pressure is maintained after the pressure in the cap was made to reach the target negative pressure as shown in FIG. 23 is obtained.

However, in association with the improvement of picture quality and throughput of the ink jet recording apparatus, the number of discharge ports of the recording head increases remarkably, so that it becomes difficult more and more to set the suction pressure and the suction amount and it is difficult to execute the suction recovery operation for keeping all of the discharge ports in a good state. That is, with respect to the removal of the bubbles in the ink flow path, a probability that the discharge ports from which the bubbles cannot be perfectly removed still remain is increasing. According to the conventional suction recovery method, since it is necessary to increase a capacity of the pump in order to cope with the above technical problems, it is necessary to enlarge a size of apparatus by a method whereby the number of tubes of the tube pump is increased, or the like.

SUMMARY OF THE INVENTION

It is an object of the invention to provide an ink jet recording apparatus which can improve suction recovery performance without enlarging a size of apparatus and keep a number of discharge ports in a good state and to provide a suction recovery method of the ink jet recording apparatus.

Another object of the invention is to provide an ink jet recording apparatus comprising: caps which cover discharge ports of a recording head; and a pump which is connected to the caps and generates a negative pressure in each cap, wherein the pump sucks the inside of the cap so that a first negative pressure is obtained and, thereafter, sucks the inside of the cap at a second negative pressure whose absolute value is larger than that of the first negative pressure.

DETAILED DESCRIPTION OF THE PREFERRED EMBODIMENTS

Figure 1:
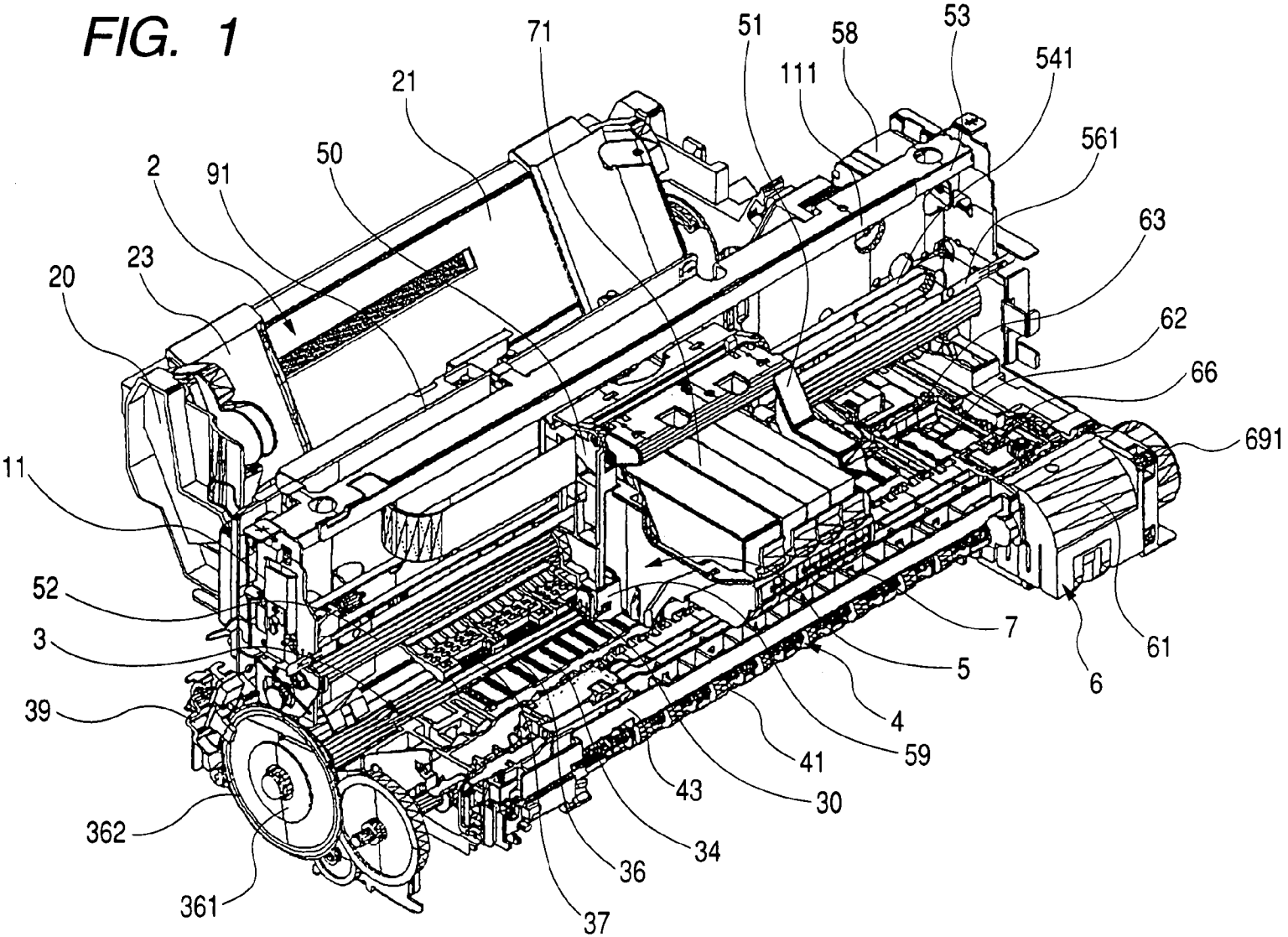
FIG. 1 is a perspective view seen from the left front side of an ink jet recording apparatus to which the invention is applied.
Figure 2:
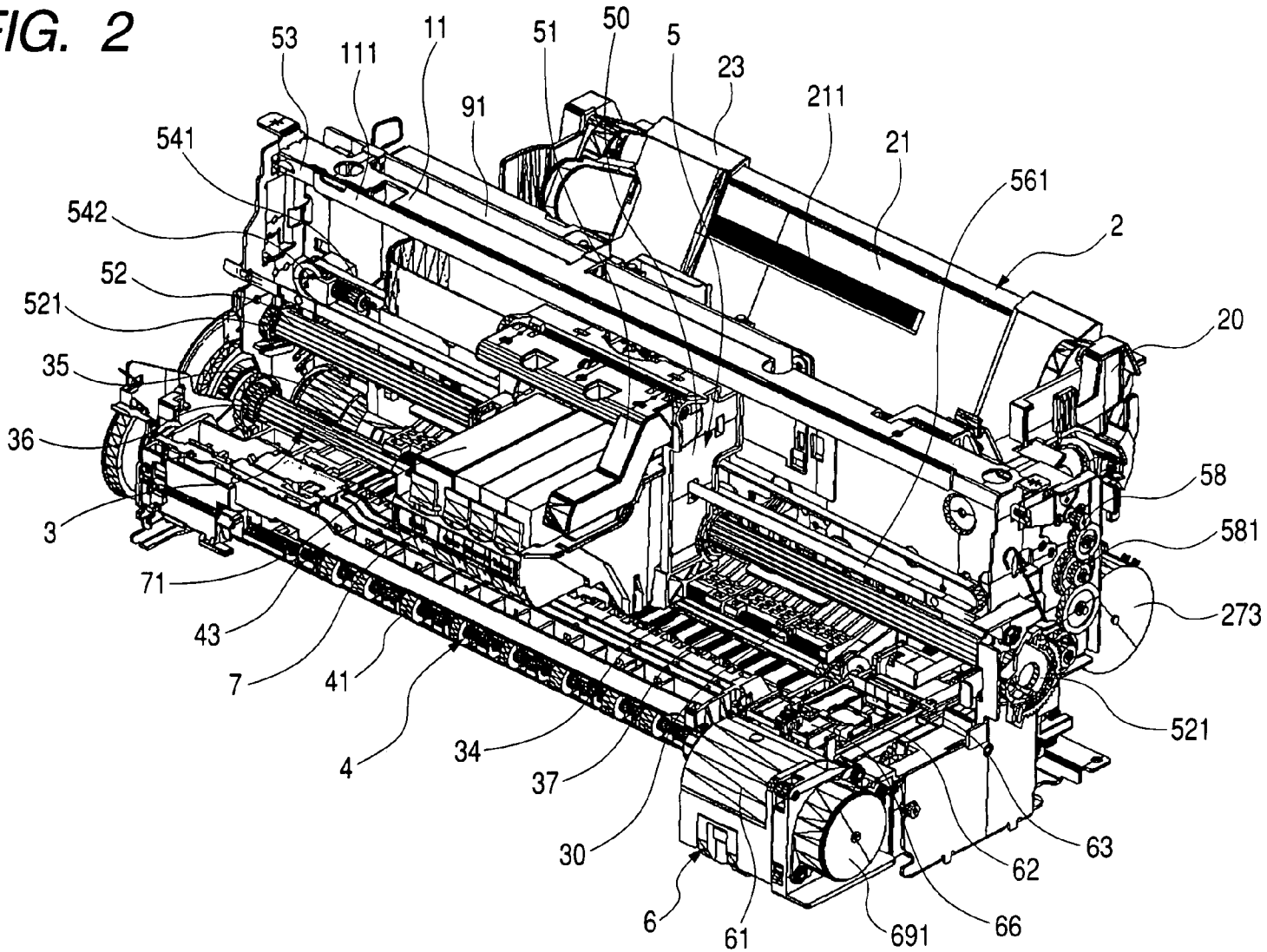
FIG. 2 is a perspective view seen from the right front side of the ink jet recording apparatus in FIG. 1.
Figure 3:
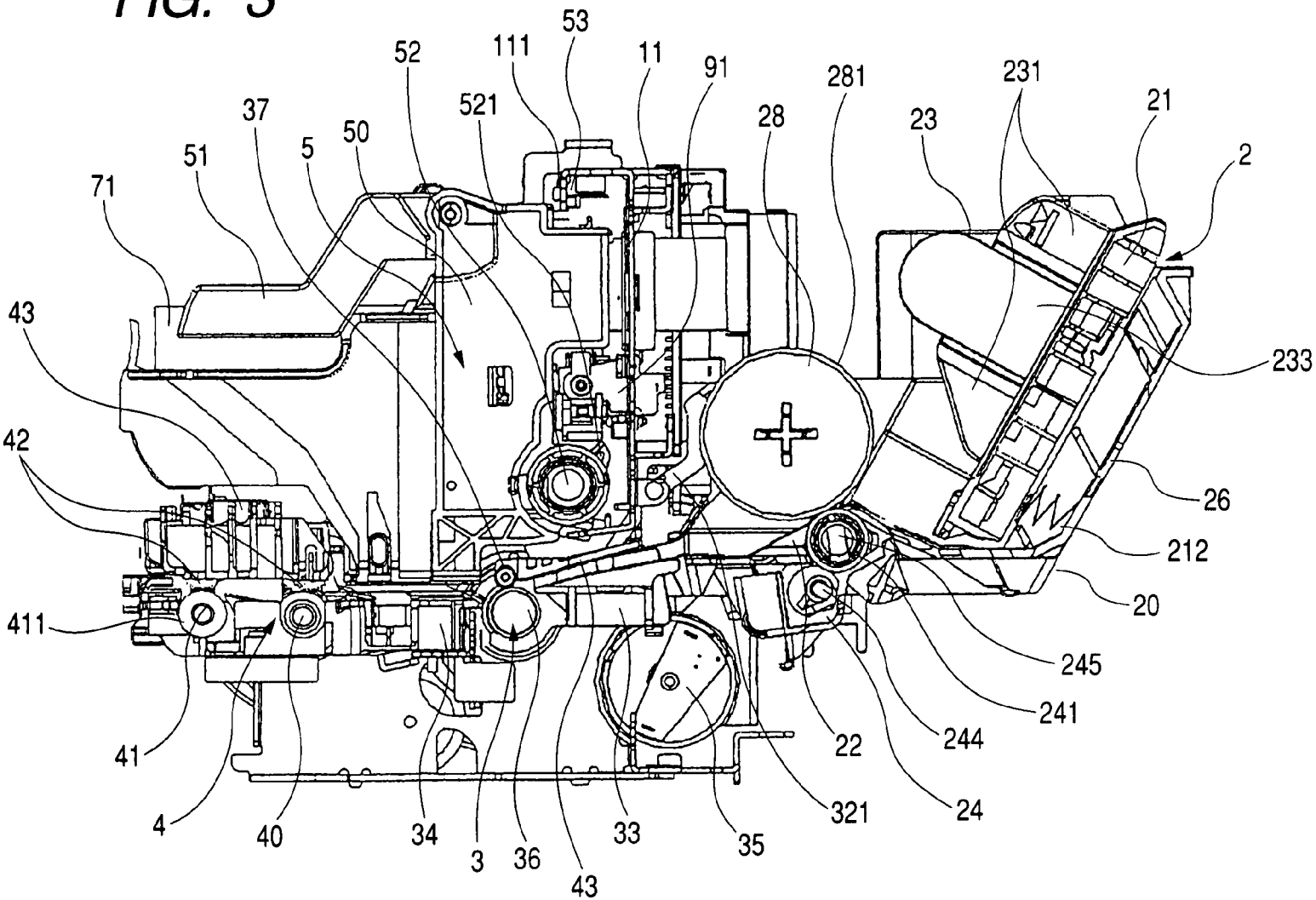
FIG. 3 is a vertical sectional view of the ink jet recording apparatus in FIG. 1.

Embodiments of the invention will now be described hereinbelow with reference to the drawings. The same or corresponding portions are designated by the same reference numerals in all of the drawings. FIG. 1 is a perspective view seen from the left front side of an ink jet recording apparatus to which the invention is applied. FIG. 2 is a perspective view seen from the right front side of the ink jet recording apparatus in FIG. 1. FIG. 3 is a vertical sectional view of the ink jet recording apparatus in FIG. 1. FIGS. 4 to 13 are diagrams for explaining a construction of a recovery device to which the invention is applied. In FIGS. 1 to 3, an ink jet recording apparatus 1 is constructed by a paper feed unit 2, a paper conveying unit 3, a paper ejecting unit 4, a carriage unit 5, a recovery unit 6, a recording head (recording means) 7, and an electric unit 9.

The paper feed unit 2 is constructed in such a manner that a pressure plate 21 on which sheet materials P are stacked, a paper feed roller 28 for feeding the sheet materials P, a separating roller 241 for separating the sheet materials P, a return lever 22 for returning the sheet materials P to a stacking position, and the like are attached onto a base 20. The paper conveying unit 3 has a conveying roller 36 for conveying the sheet material P and a PE sensor 32. The conveying roller 36 is formed by coating fine particles of ceramics onto the surface of a metal shaft. Metal portions at both ends of the conveying roller 36 are supported by bearings 38 and the roller 36 is attached to a chassis 11. A plurality of pinch rollers 37 which are driven come into contact with the conveying roller 36. The pinch rollers 37 are held in pinch roller holders 30, urged by pinch roller springs (not shown), and come into pressure contact with the conveying roller 36, thereby producing a conveying force of the sheet materials.

A code wheel 362 on which marks have been formed at a pitch of 150 to 300 lpi for detecting an amount of conveyance of the sheet material which is conveyed by the conveying roller 36 is provided on the shaft of the conveying roller 36. An encoder sensor 363 to detect the marks is attached to the chassis 11 at a position adjacent to the code wheel 362. The carriage unit 5 has a carriage 50 for attaching the recording head 7. The carriage 50 is supported by: a guide shaft 52 for reciprocation-scanning the carriage in the direction perpendicular to the conveying direction of the sheet material P; and a guide rail 111 for holding a rear edge of the carriage 50 and maintaining a gap between the recording head 7 and the sheet material P. The carriage 50 is driven through a timing belt 541 by a carriage motor (not shown) attached to the chassis 11. The timing belt 541 is suspended and supported by an idle pulley 542.

The timing belt 541 is coupled with the carriage 50 through a damper (not shown) made of a rubber or the like. The timing belt 541 attenuates a vibration of the carriage motor (not shown) or the like, thereby reducing an image fluctuation or the like. A code strip 561 on which marks have been formed at a pitch of 150 to 300 lpi for detecting the position of the carriage 50 is provided in parallel with the timing belt 541. Further, an encoder sensor (not shown) to detect the marks is attached to a carriage board (not shown) mounted to the carriage 50. A contact (not shown) for electrically connecting to the recording head 7 is also provided for the carriage board (not shown). A flexible circuit board 57 for transmitting a head signal from an electric circuit board 9 to the recording head 7 is provided for the carriage 50. To fix the recording head 7 to the carriage 50, an abutting portion (not shown) for positioning and pressing means (not shown) for pressing and fixing are provided for the carriage 50.

The pressing means (not shown) is mounted to a headset lever 51 and is constructed in such a manner that when the headset lever 51 is rotated around a rotational fulcrum as a center and set, the pressing means acts on the recording head 7. An ink jet recording head in which exchangeable ink tanks of respective colors have been separately mounted is used as a recording head 7. The recording head 7 can apply heat to the ink by a heater or the like. By the heat, film boiling occurs in the ink. The ink is discharged from discharge ports 70 of the recording head 7 by a pressure change which is caused by growth or contraction of the bubble due to the film boiling, so that an image can be formed onto the sheet material P. The paper ejecting unit 4 comprises: two paper ejecting rollers 40 and 41; spurs 42 constructed so that they come into contact with the paper ejecting rollers 40 and 41 at a predetermined pressure, are driven, and can be rotated; a gear train for transmitting a driving force of the conveying roller to the paper ejecting rollers 40 and 41; and the like.

In the above construction, an operating mode from the paper feed to the paper ejection of the ink jet recording apparatus 1 will now be described hereinbelow. When the paper feed is started, first, the separating roller 241 comes into contact with the paper feed roller 28 by the driving of the motor. The return lever 22 is released and the pressure plate 21 comes into contact with the paper feed roller 28. In this state, the paper feed of the sheet materials P is started. The sheet materials P are restricted in a front-stage separating unit (not shown) provided for the base 20. Only a predetermined number of sheet materials P are sent to a nip portion constructed by the paper feed roller 28 and the separating roller 241. The sent sheet materials P are separated in the nip portion and only the top sheet material P is conveyed to the paper conveying unit 3. The sheet material P sent to the paper conveying unit 3 is guided to the pinch roller holders 30 and conveyed to the roller pair comprising the conveying roller 36 and pinch roller 37. At this time, a PE sensor lever 321 detects a front edge of the conveyed sheet material P, thereby obtaining a recording position of the sheet material P. Since the roller pair (36 and 37) is rotated by a conveying motor 35, the sheet material P is conveyed on a platen 34.

The roller pair (36 and 37) conveys the sheet material P to the position where an image is formed (position in the conveying direction of the sheet material P). The carriage 50 is moved to a column position where the image is formed (position which crosses the conveying direction of the sheet material P) by a carriage motor 80, thereby allowing the recording head 7 to face the image forming position. After that, the recording head 7 discharges the ink toward the sheet material P in response to a signal from the electric circuit board 9, thereby forming the image. Further, the sheet material P on which the image has been formed (recorded) by the carriage unit 5 is sandwiched in the nip portion comprising the paper ejecting rollers 41 and the spurs 42, conveyed, and ejected.

Figure 4:
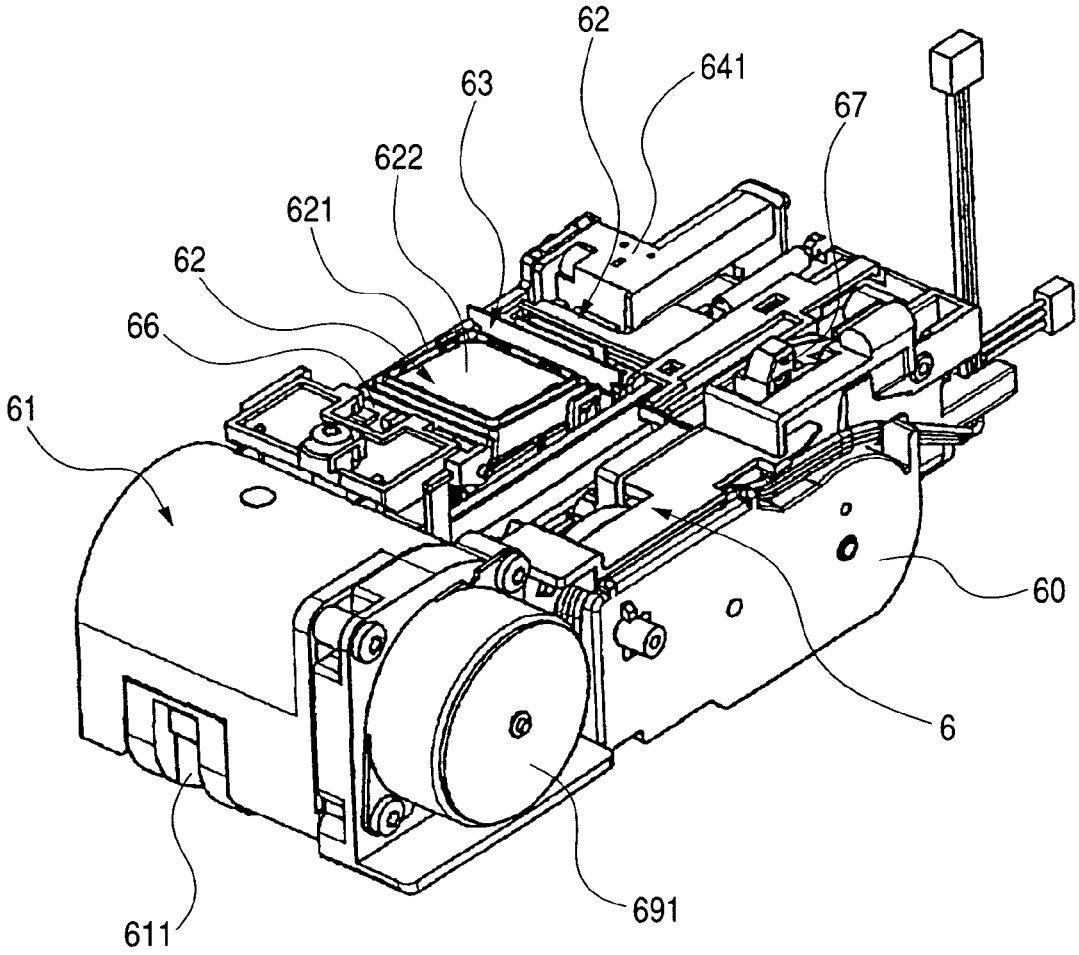
FIG. 4 is a perspective view seen from the right front side of a recovery device to which the invention is applied.
Figure 5:
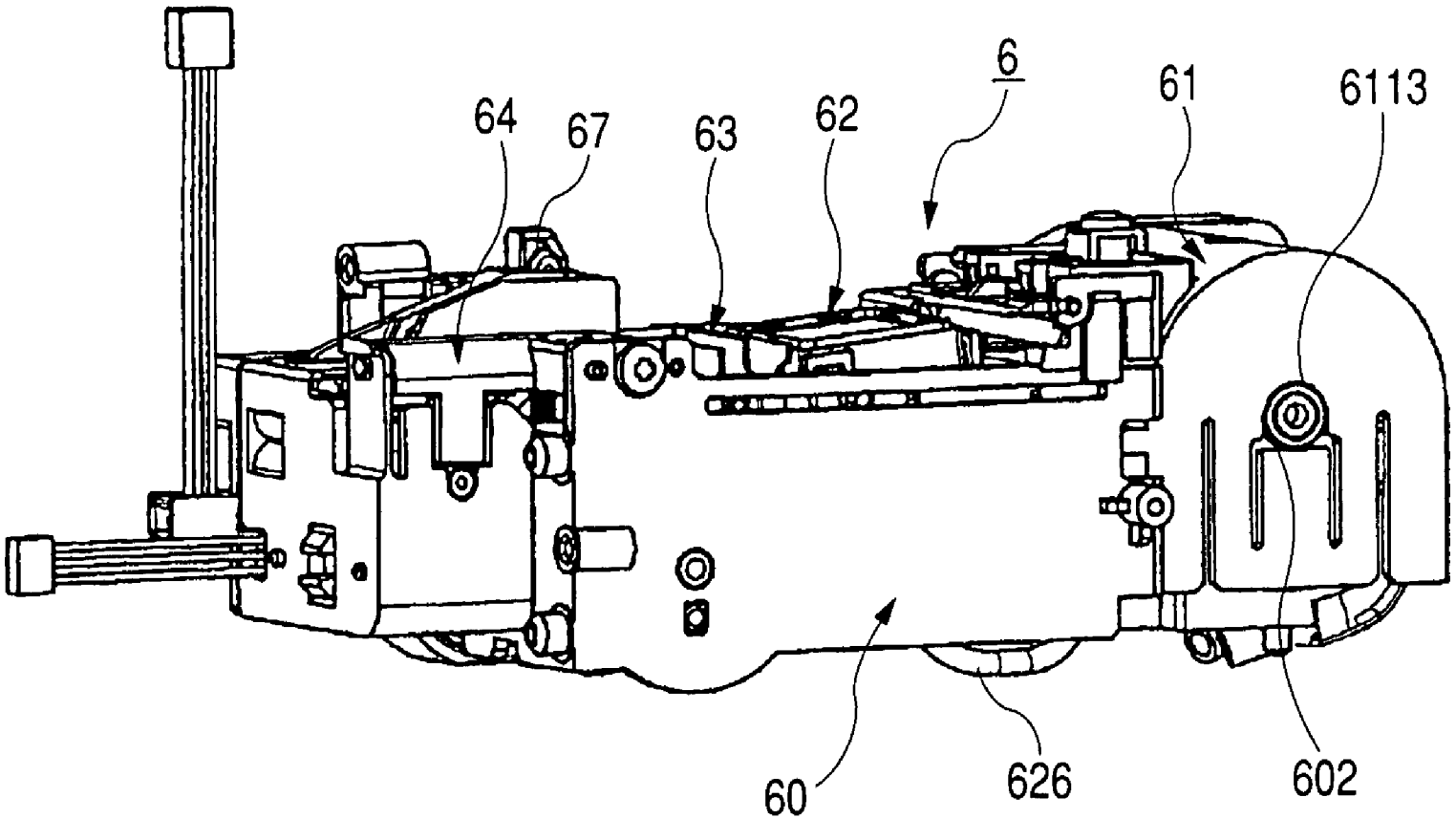
FIG. 5 is a perspective view seen from the left side of the recovery device in FIG. 4.
Figure 6:
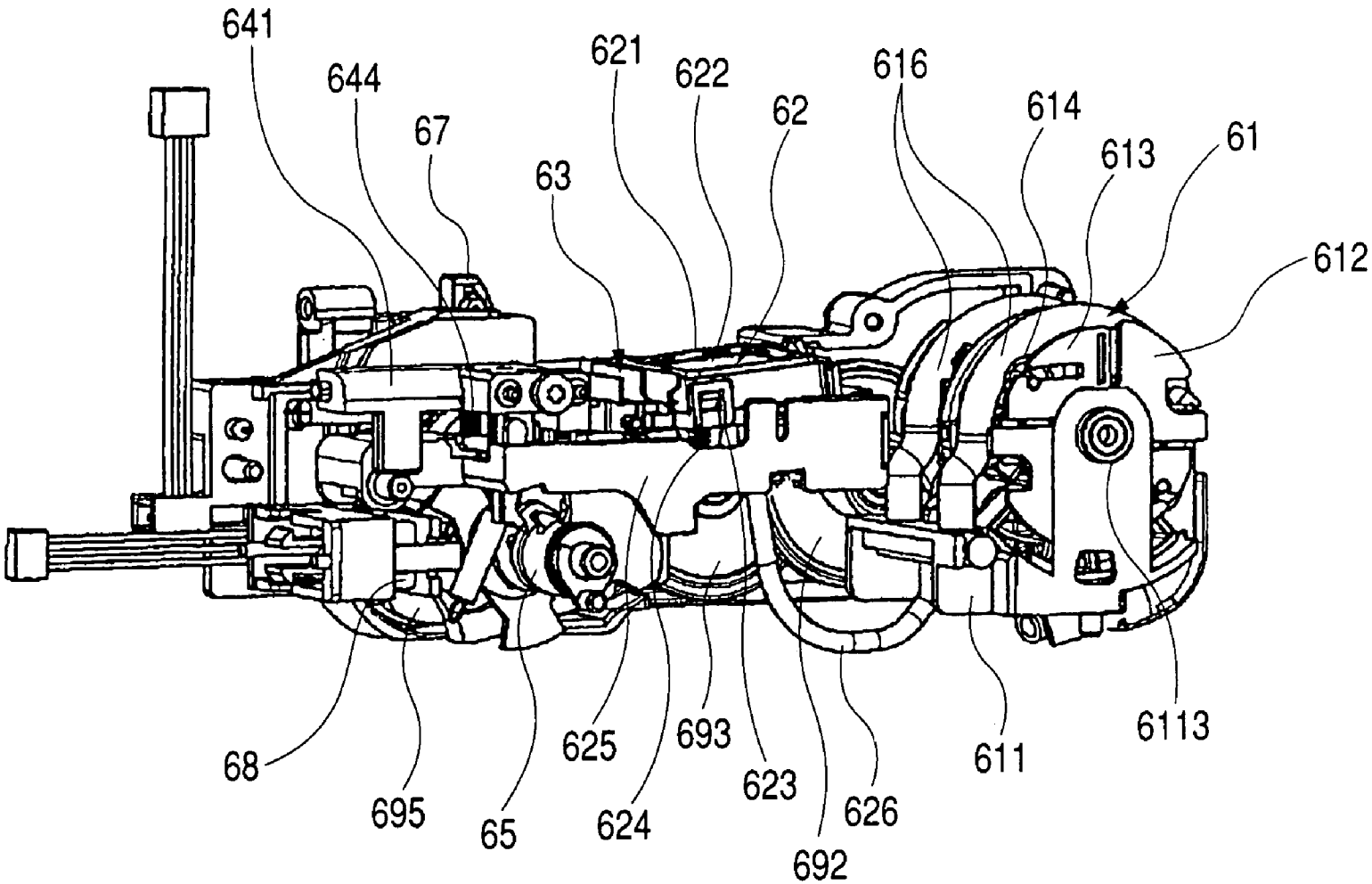
FIG. 6 is a perspective view showing an internal structure of the recovery device in FIG. 5 in the case where a recovery base is removed.
Figure 7:
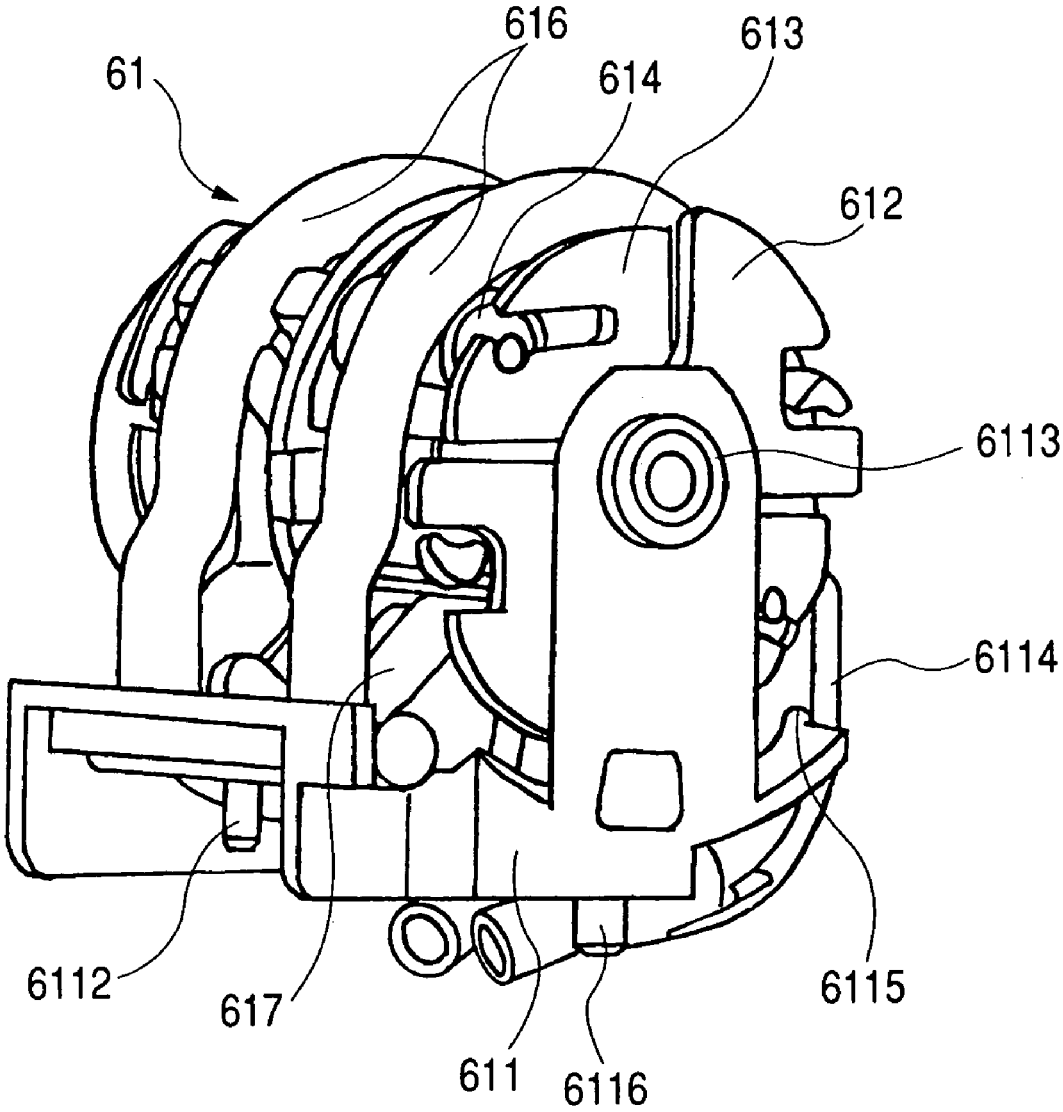
FIG. 7 is a perspective view showing a structure of a pump unit which is used in the recovery device to which the invention is applied.
Figure 8:
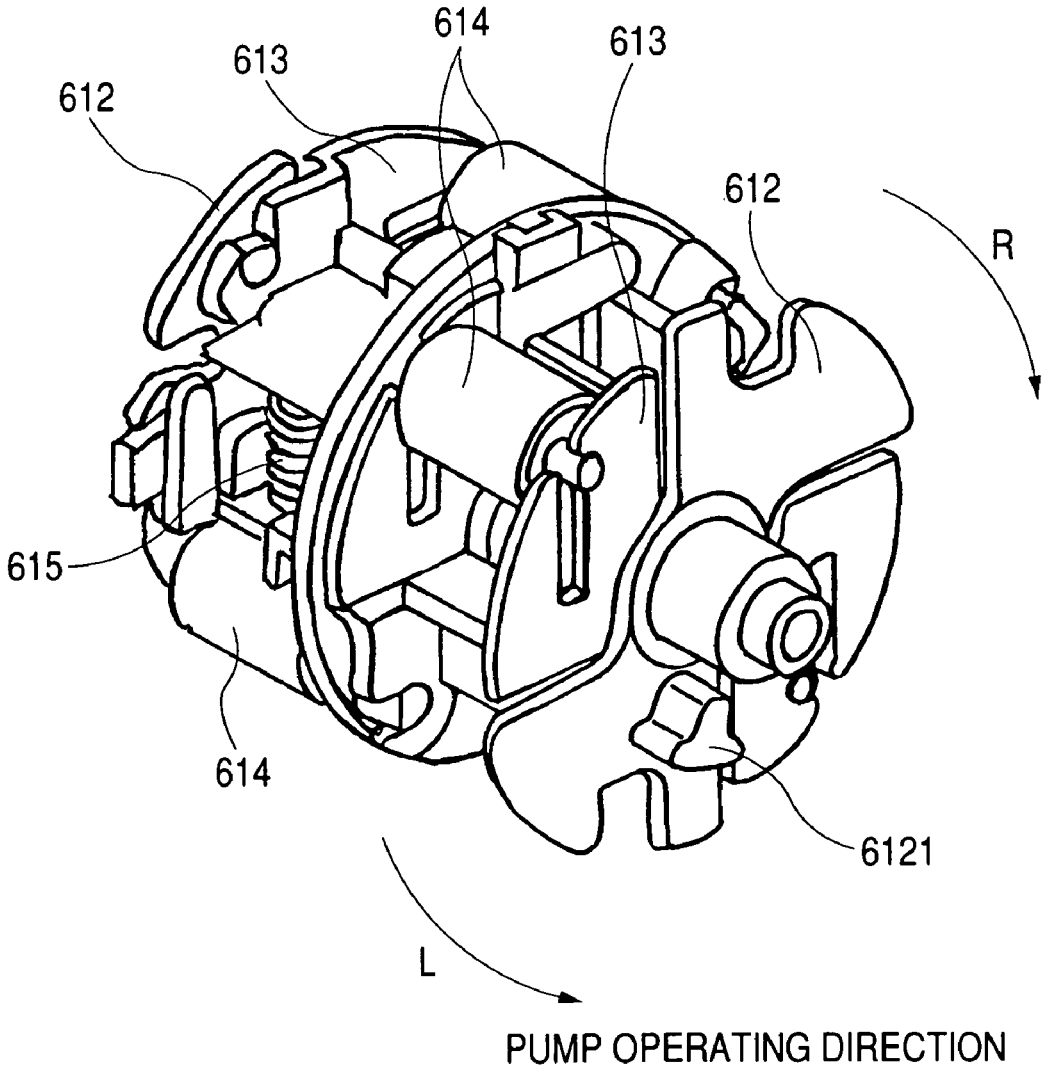
FIG. 8 is a perspective view showing a rotor of the pump unit in FIG. 7.
Figure 9:
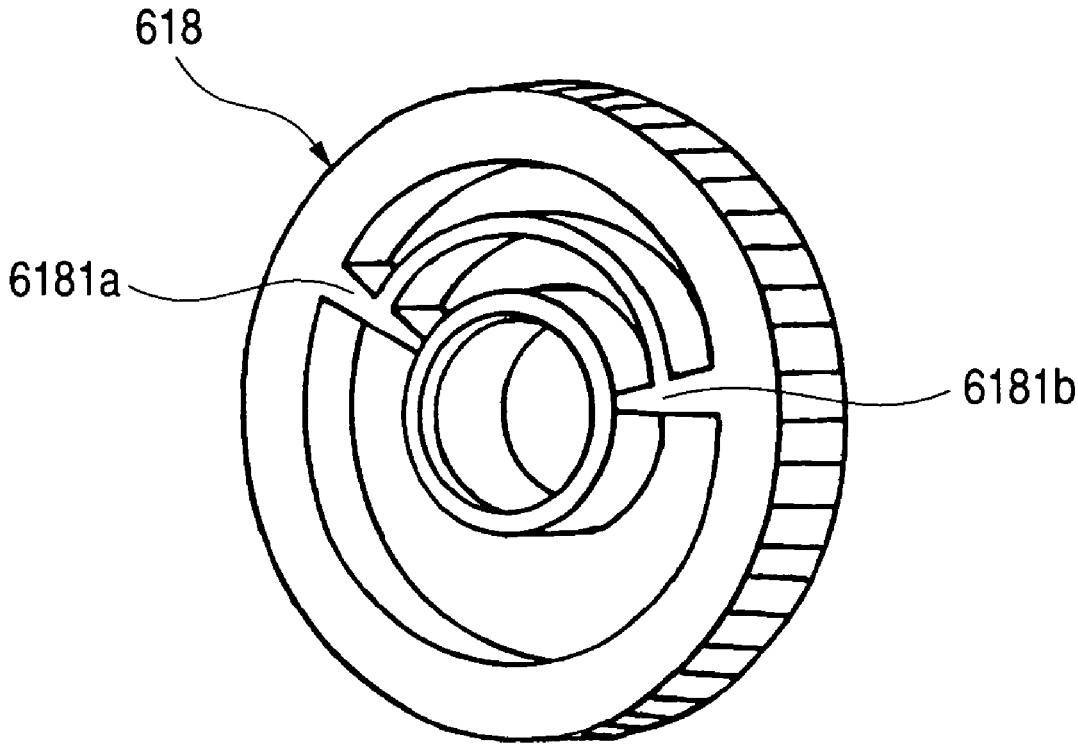
FIG. 9 is a perspective view showing a pump gear which is fitted to the rotor in FIG. 8 and transmits a rotational driving force.
Figure 10:
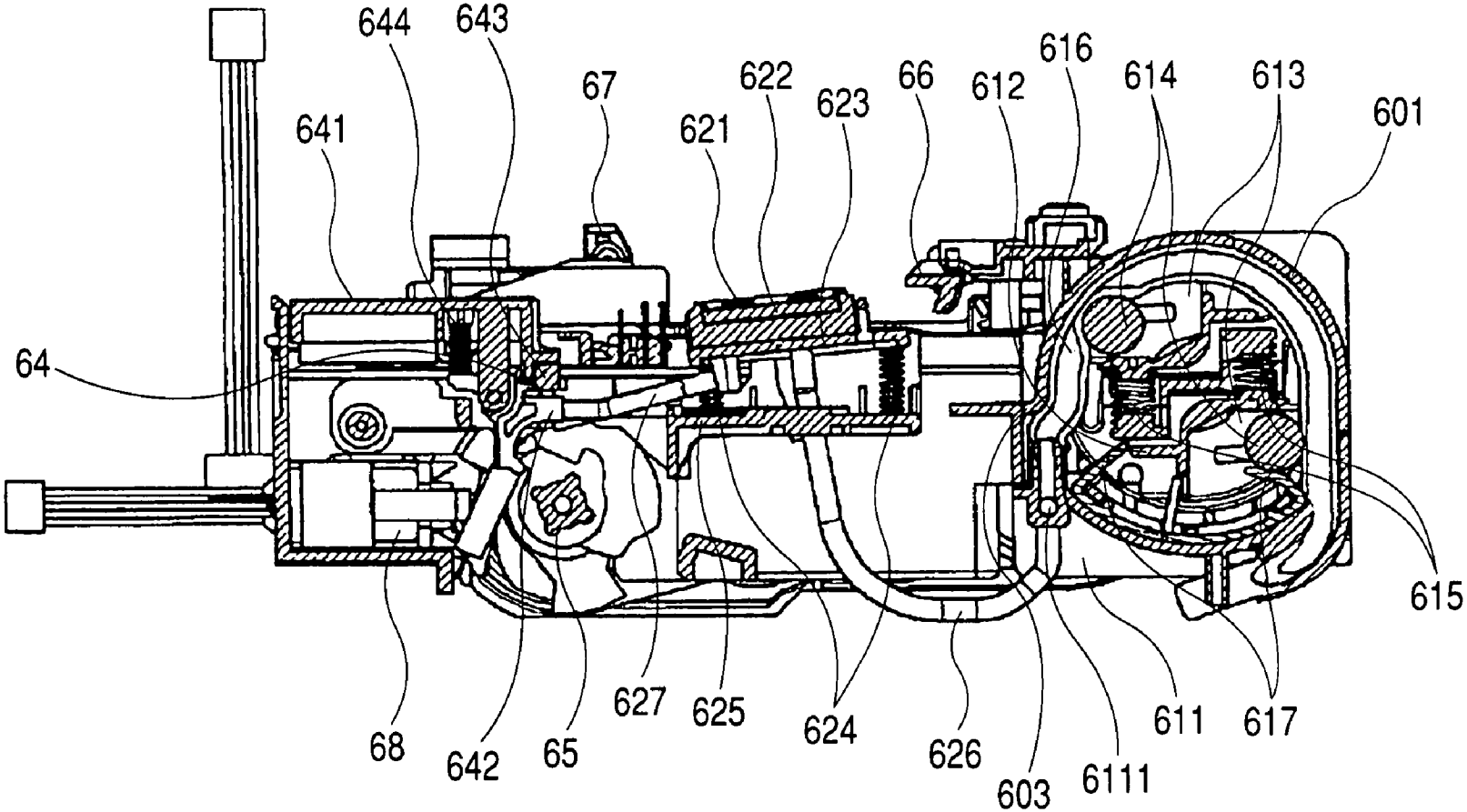
FIG. 10 is a vertical sectional view showing an internal structure of the recovery device to which the invention is applied.
Figure 11:
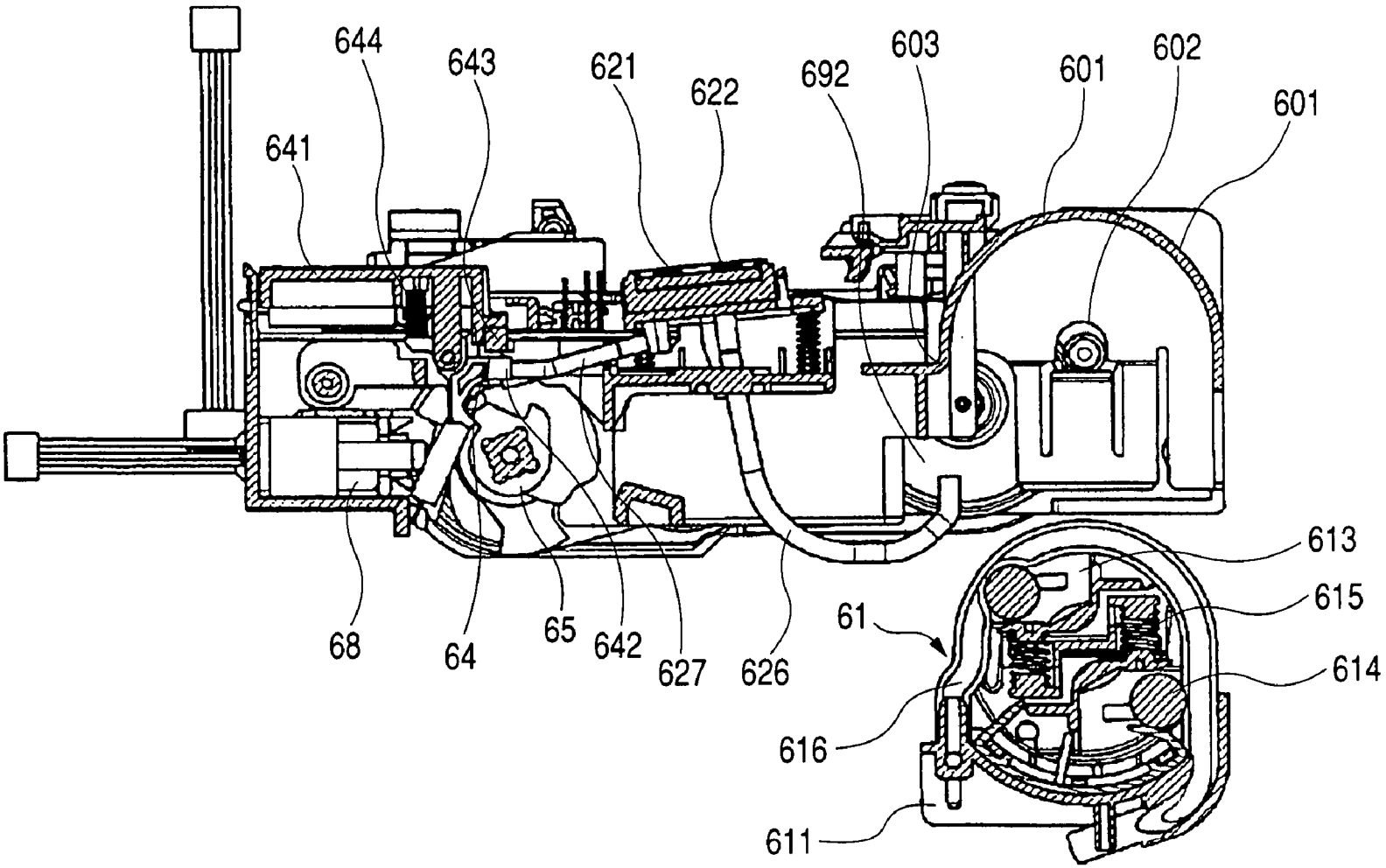
FIG. 11 is a vertical sectional view showing a state of the recovery device in FIG. 10 from which the pump unit is removed.
Figure 12:
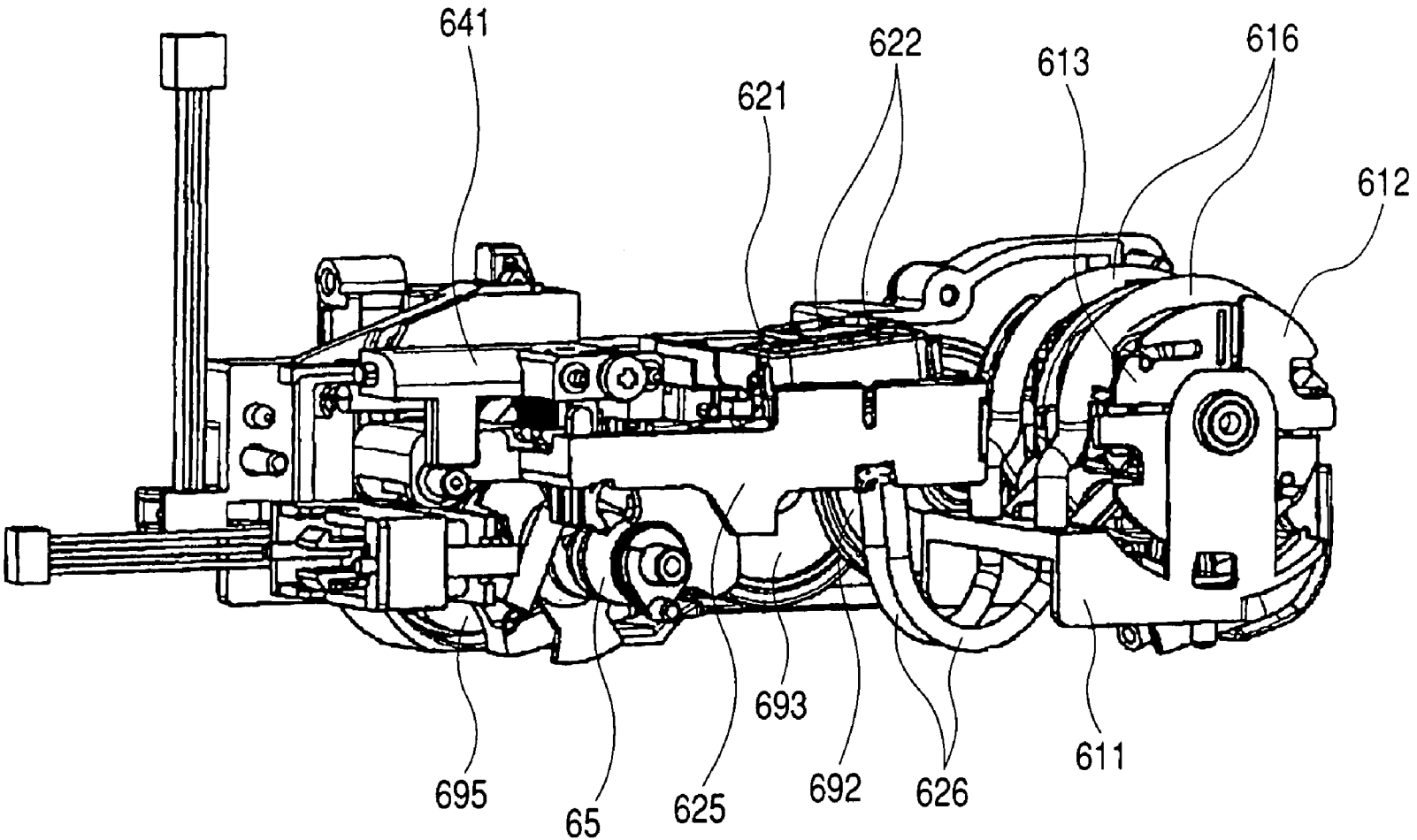
FIG. 12 is a perspective view showing an internal structure of another embodiment of a recovery device to which the invention is applied.
Figure 13:
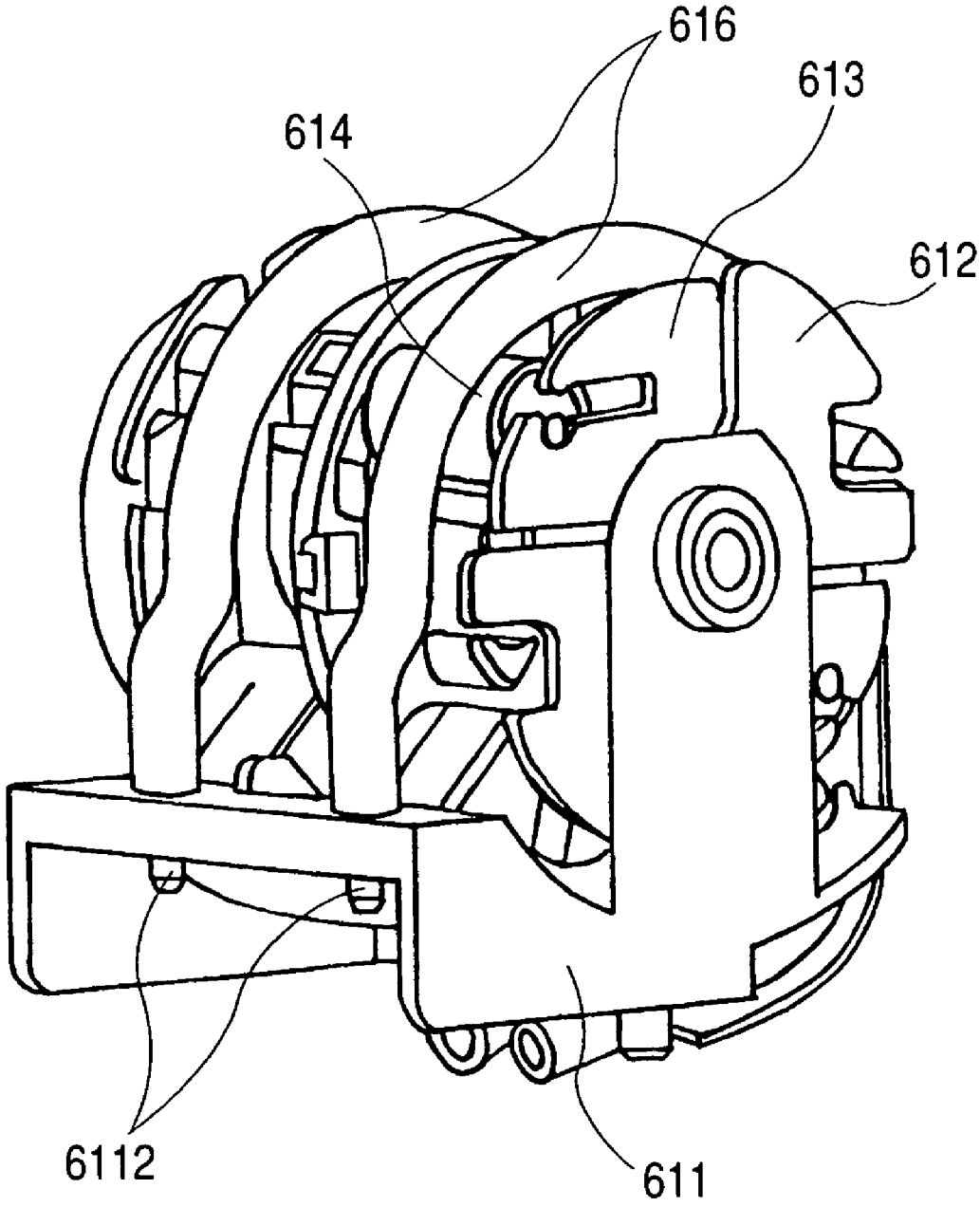
FIG. 13 is a perspective view showing a structure of a pump unit which is used in the recovery device in FIG. 12.

A construction of the recovery device (recovery unit) 6 to which the invention is applied will now be described with reference to FIGS. 4 to 13. FIG. 4 is a perspective view seen from the right front side of the recovery device to which the invention is applied. FIG. 5 is a perspective view seen from the left side of the recovery device in FIG. 4. FIG. 6 is a perspective view showing an internal structure of the recovery device in FIG. 5 in the case where a recovery base is removed. FIG. 7 is a perspective view showing a structure of a pump unit which is used in the recovery device to which the invention is applied. FIG. 8 is a perspective view showing a rotor of the pump unit in FIG. 7. FIG. 9 is a perspective view showing a pump gear which is fitted to the rotor in FIG. 8 and transmits a rotational driving force. FIG. 10 is a vertical sectional view showing an internal structure of the recovery device to which the invention is applied. FIG. 11 is a vertical sectional view showing a state of the recovery device in FIG. 10 from which the pump unit is removed. FIG. 12 is a perspective view showing an internal structure of another embodiment of the recovery device to which the invention is applied. FIG. 13 is a perspective view showing a structure of a pump unit which is used in the recovery device in FIG. 12.

In the ink jet recording apparatus 1, the recovery device 6 for recovering defective discharge of the recording head 7 is arranged in a desired position (for example, a position corresponding to the home position) out of a range of the reciprocal motion for the recording operation of the carriage 50 on which the recording head 7 has been mounted. Such a recovery device 6 generally comprises: a pump unit 61 serving as a negative pressure generating source; capping means 62 for capping the surfaces of the discharge ports of the recording head 7; and wiping means 63 for cleaning the surfaces of the discharge ports of the recording head 7. The recovery device 6 can execute a discharge recovery process for forcedly ejecting the ink from the discharge ports by the pump unit 61 in association with the capping of the discharge port surfaces by the capping means 62, thereby removing the viscosity thickened ink, bubble, or the like in the ink flow path of the recording head 7, or the like.

By capping the discharge port surfaces of the recording head 7 upon non-recording or the like, it is possible to protect the recording head 7 and prevent the ink from being dried. The pump unit 61 is connected to the capping means 62. The wiping means 63 is arranged near the capping means 62 and wipes the ink droplets adhered to the discharge port surfaces of the recording head 7. The recording head 7 can be held in the normal state by the pump unit 61, capping means 62, and wiping means 63.

The pump unit 61 has two (two systems) tubes 616 arranged in parallel. An arc-shaped inner surface formed in a part of a recovery base 60 is used as a guide surface 601. The two tubes 616 are arranged along the guide surface 601.

Each tube pump unit 610 is constructed in such a manner that the tubes 616 arranged along the arc-shaped guide portion 601 are stroked by pump rollers (pressing rollers) 614 which are axially supported (so as to be rotatable on its axis) to a rotor (a pump roller wheel 612, a pump roller holder 613) which is rotatably and axially supported to a tube guide 611 as a rotor supporting member, thereby generating a negative pressure in the tubes 616. That is, each tube pump unit 610 is constructed in such a manner that a plurality of pump rollers 614 for generating the negative pressure in the tubes 616 are axially supported so as to be movable along a guide groove in a long-hole shape of the pump roller holder 613, each pump roller 614 is urged in the tube pressing direction by a spring 615, during the suction operation for generating the negative pressure in the tubes 616, the pump roller 614 is made operative so as to stroke the tubes 616 while rotating (rotating on its axis, revolving arbitrarily) the pump roller 614, and in the operation other than the suction operation, the pump roller 614 is made operative so as to retract from the tubes 616. Two pump rollers 614 are arranged for each of the two tubes 616, that is, four pump rollers 614 in total are arranged.

In the embodiment, the guide portion 601 of the recovery base 60 for guiding the tubes 616 is a semicircular shape. Two pump rollers 614 are arranged for each tube 616 so as to have an angular phase of 180°. By constructing the apparatus as mentioned above, even at a momentary time point when one pump roller 614 is away from the tube in the state where it presses the tube 616, the other pump roller 614 can be set to the state where it presses the tube 616. By continuously rotating the two pump rollers 614, the suction operation can be continuously executed while keeping the negative pressure in the tube 616. When the guide portion 601 has an almost circular shape, a similar effect can be realized even by one pump roller.

The pump roller holder 613 is axially supported to the pump roller wheel 612 so that it can swing in the radial direction of the arc-shaped guide surface 601 of the recovery base 60, and functions so as to press and retract the pump roller 614 to/from the tube 616. The pump roller wheel 612 is attached in such a manner that axis portions at both ends are axially supported at the center position of the arc of the arc-shaped guide portion 601, so that a driving force from a recovery motor 691 is transmitted, thereby enabling the pump roller wheel 612 to be rotated. In the embodiment, the rotor for supporting the pump rollers 614 is constructed by the pump roller wheel 612 and the pump roller holder 613. This rotor is rotatably and axially supported by the tube guide 611.

When the driving force is transmitted from the recovery motor 691 to the pump unit 61, it is transmitted through a recovery gear 692 to a pump gear 618 arranged so as to be coaxial with a rotary axis of the pump roller wheel 612. The rotational driving force of the pump gear 618 is transmitted when a boss (projecting portion) 6121 arranged on one edge surface of the pump roller wheel 612 comes into contact with ribs 6181*a* and 6181*b* by the rotation of the pump gear 618. That is, the rotational driving force to the pump unit 61 is transmitted through a rotation transmitting mechanism having a play (dead area) of a predetermined angular range.

A shape of the pump gear 618 will now be described with reference to FIG. 9. The pump gear 618 has two ribs (6181*a* and 6181*b*) therein and a space is provided on the side surface. When the boss 6121 which enters the space comes into contact with both of the ribs 6181*a* and 6181*b*, the rotational force is transmitted to the pump roller wheel 612, so that the pump unit 61 is driven. The pump unit 61 is directly coupled for the rotational driving of the recovery motor 691 and constructed so as to operate in such a maimer that the suction operation is executed by the unidirectional rotation (normal rotation) of the recovery motor 691 and the pump roller 614 is moved from the pressing state to the tube 616 in the cancelling direction by the reverse directional rotation (reverse rotation). A bearing portion 6113 for axially supporting the pump roller wheel 612 is provided for the tube guide 611.

In the state where the tube 616 is wrapped around the pump roller wheel 612, one end portion of the tube 616 is sandwiched by a guide portion 6114 of the tube guide 611 and fixed to retaining portions 6115 and 6116. The other end portion of the tube 616 is inserted into joint portions 6111 integratedly provided for the tube guide 611 and fixed. The two joint portions 6111 are integrated and coupled with one joint portion 6112 by a pipe line. A joint tube 626 connected to the capping means 62 is coupled with the joint portion 6112. The reason why the two tubes 616 are integrated with one joint tube 626 and connected to the capping means 62 is to prevent a variation from occurring in an ink outflow state from each discharge port of the recording head 7 corresponding to each area in the cap or a flowing state of the ink in the cap due to a negative pressure difference which is caused by a parts tolerance or the like between the two tubes 616.

As mentioned above, one tube pump unit 610 is constructed by the tube guide 611, the pump roller wheel 612, the pump roller holder 613, the pump rollers 614, the spring 615, the tubes 616, and a pump roller damper 617. In the embodiment, the pump unit 61 is constructed by coupling two sets of such a tube pump unit. The pump roller wheel bearing portion 6113 of the tube guide 611 is projected outwardly from the tube guide 611. Since the bearing portion 6113 is retained to a fixing portion 602 at the center of the guide portion 601 which comes into pressure contact with the tubes 616 in cooperation with the pump rollers 614 of the recovery base 60, the pump unit 61 comprising the two tube pump units 610 is fixed to the recovery base 60, so that a construction completed as suction means is realized.

At this time, the upper portions of the pressure inserting portions of the tubes 616 and the joint portions 6111 of the tube guide 611 are pressed by a pump tube presser 603 provided for the recovery base 60, thereby preventing the tubes 616 from being pulled out even if a force for pulling from the joint portions 6111 acts thereon. By using the fixing means of the tubes 616, an assembling state of the tubes 616 in a contact start portion and a portion near an escape portion of the pump roller 614 can be set to the state where bending and a crush are small. It is possible to prevent the occurrence of a load fluctuation upon insertion or escaping of the pump roller 614 or a prerotation phenomenon (phenomenon in which the pump roller 614 is previously rotated in the rotating direction) for the driving means.

The capping means 62 is constructed by: a cap 621 which comes into contact with the discharge port surfaces of the recording head 7; a cap absorber 622 for sucking the ink which is emitted from the discharge port surfaces of the recording head 7; a cap holder 623 for supporting the cap 621 and allowing the cap 621 to be come into contact with the discharge port surfaces of the recording head 7 by a cap spring 624; the cap spring 624 for applying a cap pressure to the cap holder 623; a cap base 625 as an elevation lever for supporting the cap spring 624, supporting the cap holder 623 so as to be vertically slidable, and allowing the cap 621 to come into contact with or be away from the discharge port surfaces of the recording head 7; the joint tube 626 for coupling the inside of the cap 621 with the pump unit 61; and a valve tube 627 for coupling the inside of the cap 621 with a closing valve 64 for releasing to the atmosphere.

The valve 64 is constructed by assembling a valve lever 642, a valve rubber 643, and a valve lever spring 644 to a valve base 641. The valve lever 642 is rotatably and axially supported to the valve base 641. A pipe line is formed in the valve lever 642. One end portion of the valve lever 642 is a joint portion for connecting to the valve tube 627 and the other end portion is a closing valve portion for switching an opening/closing state of the pipe line of the valve 64 by coming into contact with or being away from the valve rubber 643 by the rotation of the valve lever 642. The valve lever spring 644 urges the valve lever 642 in the direction in which it comes into contact with the valve rubber 643. By opening or closing the valve 64, the inside of the cap 621 connected by the valve tube 627 is switched to an opening/closing state with the atmosphere.

In the embodiment, the cap absorber 622 is provided in the cap 621. The elevating operation for allowing the capping means 62 to come into contact with the recording head 7 and the opening/closing operation of the valve 64 are executed by transmitting the driving force from the recovery motor 691 (FIG. 4) via recovery gears 693 and 694 or the like through a one-way clutch gear 695. The one-way clutch gear 695 is fitted to a cam 65 for executing the elevating operation of the capping means 62 and the opening/closing operation of the valve 64 and constructed in such a manner that upon unidirectional rotation, the driving force from the recovery motor 691 is transmitted to the cam 65, and upon rotation in the other direction, the gear 695 slips so as not to transmit the driving force to the cam 65. The cam 65 is constructed in such a manner that it controls the operation of the capping means 62, controls the driving of the wiping means 63, and controls the elevating operation of a CR locking lever 67 for positioning the recording head 7 and the capping means of the recovery device 6 during the recovery operation of the recording head 7. The operation of each of the means mentioned above is executed by a method whereby a rotating position of the cam 65 is determined by a flag for a cam position detecting sensor 68 provided for the cam 65 and the cam position detecting sensor 68 and each means is controlled on the basis of the decided rotating position.

Figure 14:
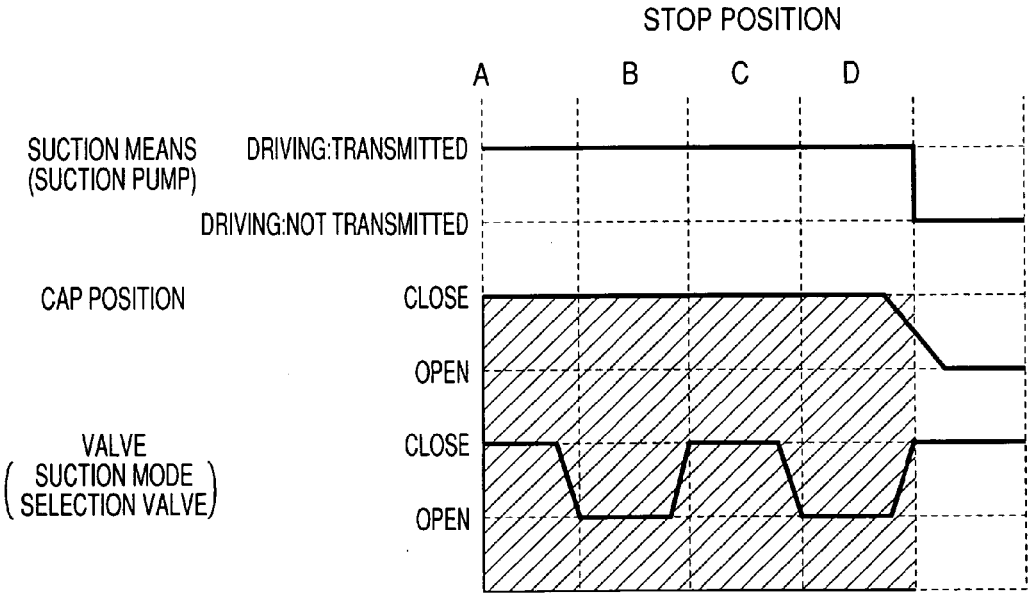
FIG. 14 is a cam chart showing a stop position of a cam for operation control.
Figure 15:
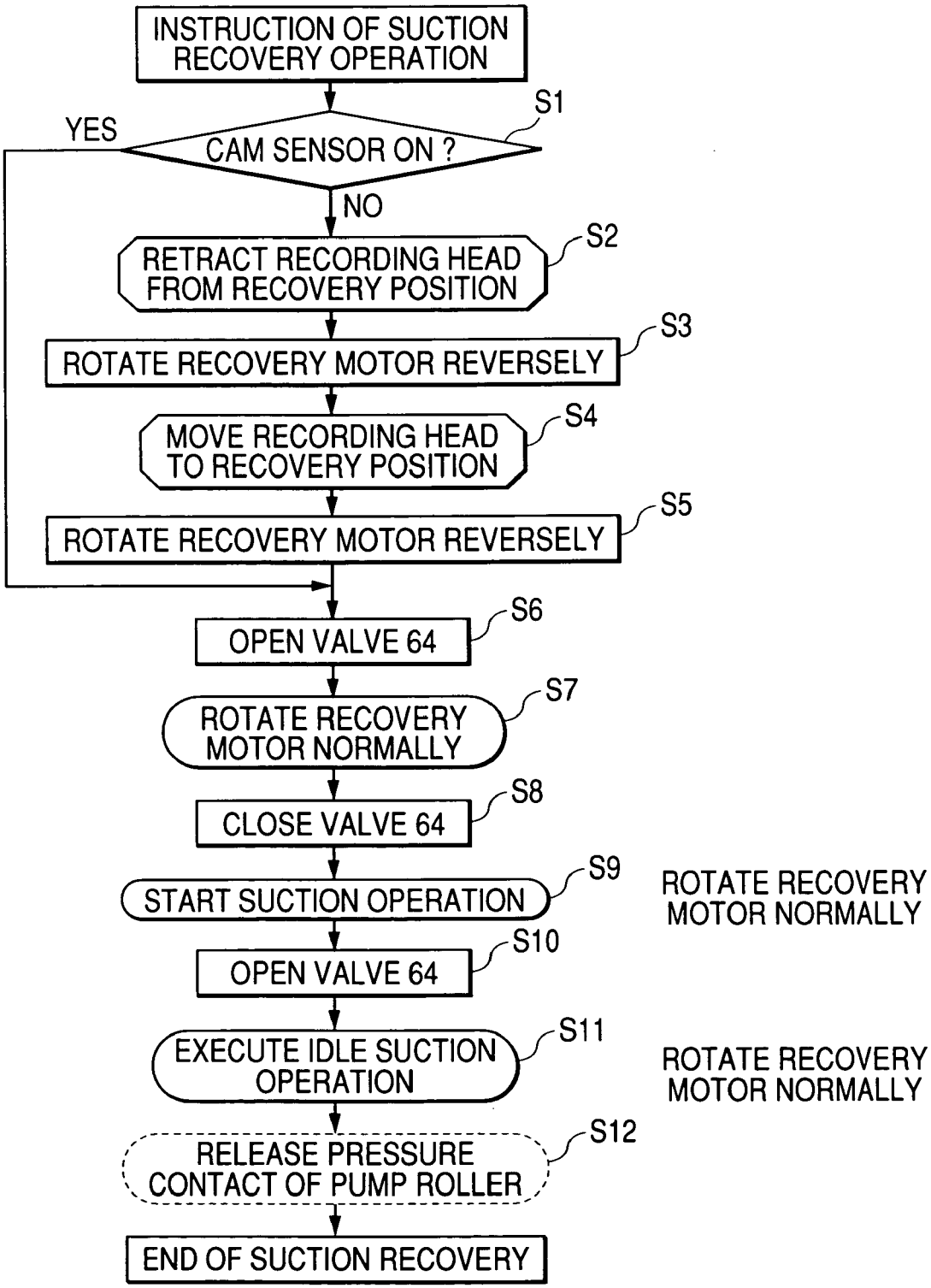
FIG. 15 is a flowchart for the suction recovery operation.
Figure 16:
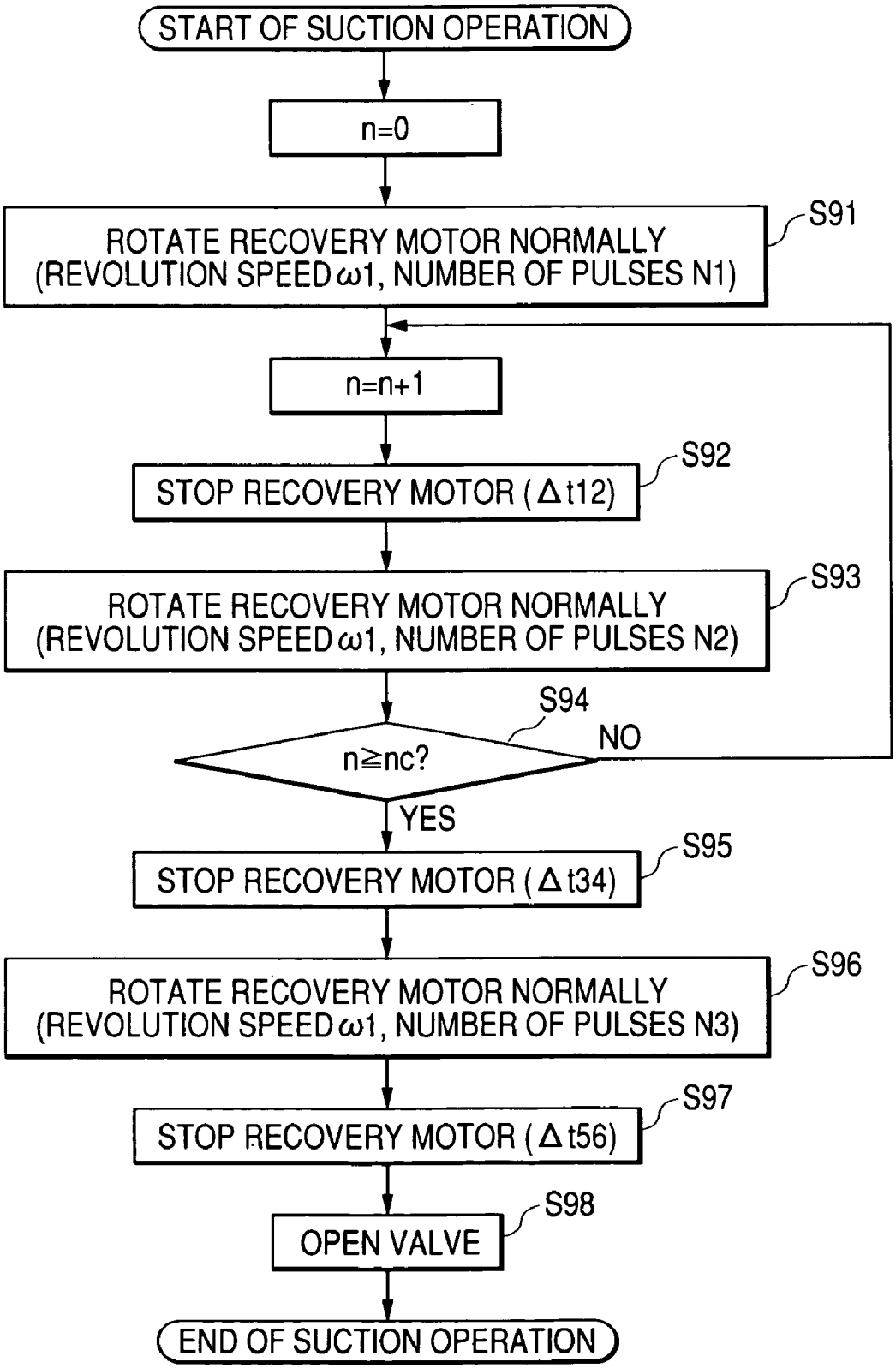
FIG. 16 is a flowchart for a suction recovery method according to an embodiment 1.
Figure 17:
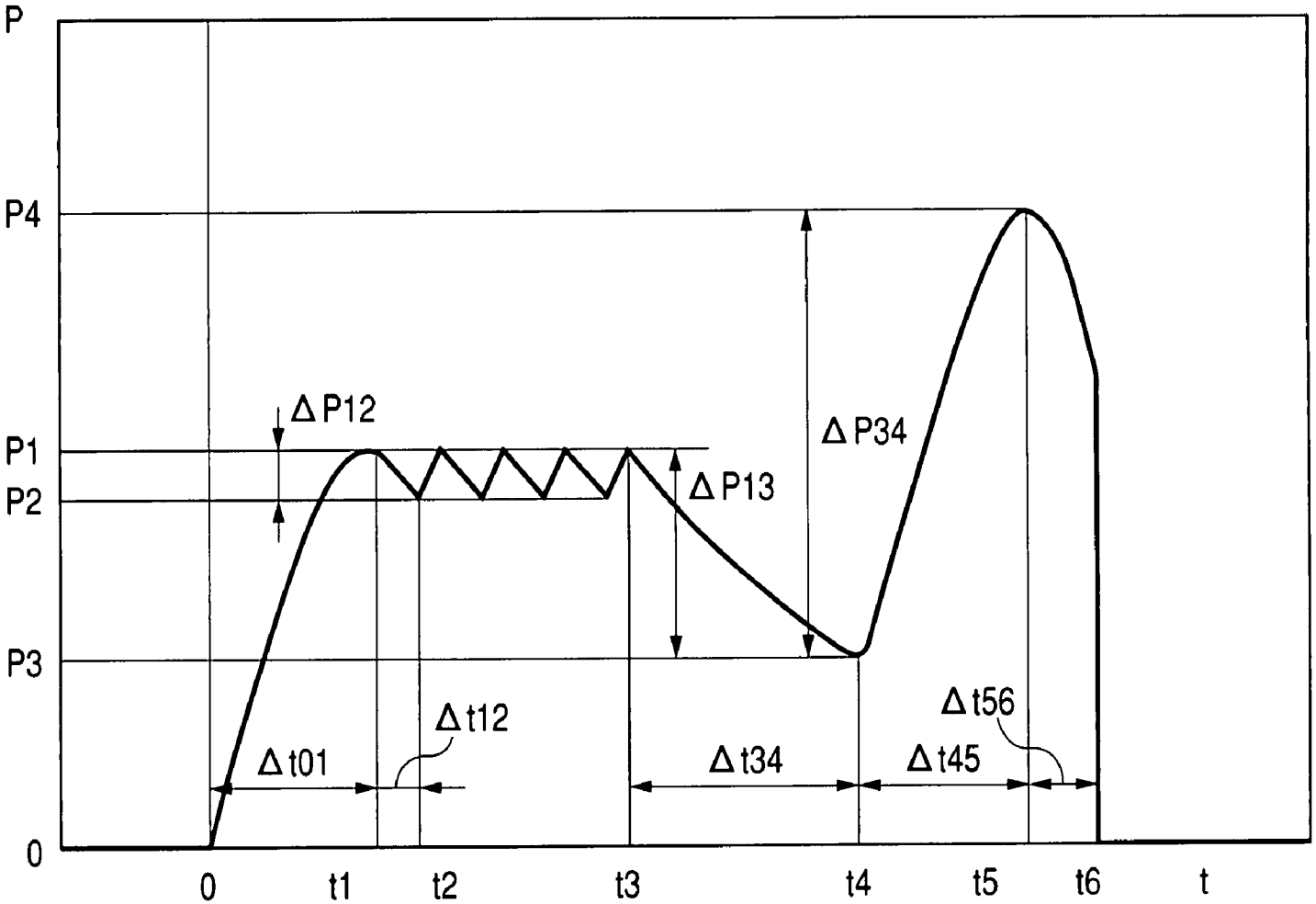
FIG. 17 is a graph showing a fluctuation state of a negative pressure due to the suction operation according to the embodiment 1.

FIG. 14 is a cam chart showing a stop position of the cam for operation control. FIG. 15 is a flowchart for the suction recovery operation. FIG. 16 is a flowchart showing a sequence of a suction recovery method according to the embodiment 1. FIG. 17 is a graph showing a fluctuation state of the negative pressure due to the suction operation according to the embodiment 1. The suction recovery mode shown in FIGS. 14 and 15 is executed by such a sequence that the pump unit 61 for executing the suction recovery is driven by the unidirectional driving of the recovery motor 691 and, by the driving in the reverse direction, both of the capping means 62 for allowing the cap 621 to come into contact with or be away from the discharge port surfaces of the recording head 7 and the wiping means 63 for wiping the discharge port surfaces of the recording head 7 are driven and controlled by both of the cam 65 coaxially having the flag portion for the position detection and the sensor 68.

In FIG. 14, stop positions A to D of the cam correspond to the following states.

Cam Position

A: recovery system HP (the valve is closed)

B: initialization of pressing roller (the valve is open)

C: suction operation (the valve is closed)

D: idle suction operation (the valve is open)

A hatched region in FIG. 14 shows an area where there is no driving transmission to the suction means side (within a driving range of the cam on the suction mode selection side).

The sequence of the suction recovery mode in the embodiment will now be described hereinbelow with reference to the flowchart of FIG. 15. When an instruction of the suction recovery operation is issued, the position of the cam 65 constructing the recovery device 6 is detected by the sensor 68 and the positions of the capping means 62, the wiping means 63, and the like are confirmed (step S1). When the cam sensor is ON, that is, when the cam 65 exists at the normal or good position, the operations in subsequent steps S3 to S5 are unnecessary and the processing-routine is jumped to step S6. When the cam sensor is OFF, the recording head 7 is retracted from the position of the suction recovery operation (step S2). The recovery motor 691 is driven until the apparatus enters the state where the recording head 7 and the capping means 62, the wiping means 63, and the like are not interfered (step S3). After such a state is confirmed by the sensor 68, a carriage motor 54 is driven, thereby moving the recording head 7 to the position of the suction recovery operation (step S4).

After that, by rotating the cam 65 by the driving of the recovery motor 691, the capping means 62 comes into contact with the discharge port surfaces of the recording head 7 (reverse rotation until the cam position detecting sensor is ON) (step S5). At this time, since the rotating direction of the pump roller wheel 612 is a direction shown by an arrow R in FIG. 8, the pump roller 614 exists at a position away from the tubes 616, thereby communicating the inside of the cap 621 with the atmosphere. Therefore, even if the pump roller wheel 612 is rotated, such a situation that the ink remaining in the tubes 616 reversibly flows into the cap or a positive pressure is applied into the cap and an adverse influence is exerted on the discharge ports of the recording head 7 does not occur. As a preparation for entering the suction recovery operation after the cap 621 comes into contact with the discharge port surfaces of the recording head 7, in order to once press the pump roller 614 to the tubes 616, the recovery motor 691 is driven in the direction where a rotation in the direction shown by an arrow L in FIG. 8 is applied to the pump roller wheel 612.

At this time, since the capping means 62 is in contact with the discharge port surfaces of the recording head 7, in order to prevent an extra negative pressure from being applied into the cap when the pump roller wheel 612 is rotated to the side of the rotating direction R, the valve 64 for pump roller initialization is left opened by the rotation of the cam 65 when the cap 621 comes into contact with the recording head 7 (step S6). Therefore, by the driving in the normal rotating direction of the recovery motor 691, the pump gear 618 obtains the rotational force in the L direction and continues to rotate (step S7), thereby allowing the boss 6121 of the pump roller wheel 612 to come into contact with the ribs 6181*a* and 6181*b* of the pump gear 618 and rotating the pump roller wheel 612 in the L direction. Thus, the apparatus is set into the state where the pump rollers 614 press the tubes 616.

The above operation performs such a function that when the instruction of the suction recovery operation is issued, in order to enable the stable suction recovery operation irrespective of the position of the pump roller 614, by selecting the position of the pump roller 614 to the position where the tube 616 is pressed, the variation in pressing crush amount of the tube 616, that is, ink suction amount in a dead area until the pump roller 614 presses the tube 616 is suppressed. By performing such an initial position selection of the pump roller 614 as mentioned above, even if the pump roller sensor necessary for detecting the position of the pump roller 614 does not exist, the variation in ink suction amount can be reduced, thereby enabling the stable suction recovery operation to be executed.

After the pump roller 614 is pressed to the tube 616 as mentioned above, by rotating the pump unit 61 in the normal rotating direction, the ink suction operation from the recording head 7 is executed. This suction operation is executed by a method whereby by closing the valve 64 of the capping means 62, the inside of the cap 621 is closed (step S8) and a negative pressure is applied into the cap by the pump unit 61, thereby emitting the ink from the recording head 7 (step S9). The closing/opening of the inside of the cap is controlled by closing/opening the valve 64 by the rotation of the cam 65.

Since the operation of the valve 64 mentioned above is also executed by using the recovery motor 691 as a driving source, the closing operation of the valve 64 has to be accomplished without breaking the pressing state of the pump roller 614 executed as a preparation of the suction recovery operation. Therefore, while the cap 621 is in contact with the recording head 7, when the valve 64 is made operative by rotating the cam 65 through the one-way clutch gear (not shown) by the driving of the recovery motor 691, the ribs 6181*a* and 6181*b* of the pump gear 618 are come into contact with the boss 6121 provided at the edge surface of the pump roller wheel 612, thereby preventing the driving force of the recovery motor 691 from being transmitted to the pump unit 61 side. That is, the apparatus is constructed in such a manner that in the state where the driving force is transmitted to the cam 65 side by the recovery motor 691, the transmission of the driving force to the pump unit 61 is cancelled during the,opening/closing state of the valve 64 (hatched region in FIG. 14).

Therefore, an interval between the ribs 6181*a* and 6181*b* of the pump gear 618 is set to such an interval that in the hatched region shown in FIG. 14, the driving force of the recovery motor 691 is not transmitted to the pump unit 61 side in consideration of a rotational angle of the cam 65 in the opening/closing operation area of the valve 64, a reduction ratio of a gear of a driving transmitting unit from the recovery motor 691 to the pump unit 61, and a reduction ratio of a gear for transmitting the driving force to the cam 65. After the suction recovery operation for sucking a predetermined amount of ink is executed by rotating the recovery motor 691 in the direction (normal rotating direction) where the driving force is applied to the pump unit 61 side, the valve 64 is set into the open state by the rotation of the cam 65 in order to eject the drain ink stored in the cap 621 (step S10).

At this time, if the driving force is transmitted to the pump unit 61 during the opening operation of the valve 64, since the driving direction is the reverse rotating direction, the ink is made to reversibly flow from the tube 616 into the cap 621 due to the stroke of the tube 616 by the pump roller 614, so that the recording head 7 is damaged. In the embodiment, however, even during the above operation, since the apparatus is constructed so as to rotate the pump unit 61 from the state where the ribs 6181*a* and 6181*b* of the pump gear 618 are in contact with the boss 6121 of the pump roller wheel 612 to the side where they are away from the boss, the pump unit 61 is not rotated and the inconvenience due to the back flow of the ink is not caused. After the valve 64 is opened, the pump unit 61 is driven by the recovery motor 691 in the direction (normal rotating direction) where the suction recovery operation is executed, and the idle suction operation for ejecting the ink remaining in the cap to the outside of the discharge recovery device by the negative pressure which is generated at this time is executed (step S11). After completion of the idle, suction operation, the pump roller 614 is set into the state where the depression of the tube is cancelled (step S12). In this manner, the suction recovery operation shown in FIG. 15 is terminated.

The suction operation will now be described with reference to a negative pressure fluctuation curve at the time of the suction operation in FIG. 17 on the basis of the flowchart of the suction operation in FIG. 16. In FIGS. 16 and 17, first, there is started a first suction step in which by normally rotating the recovery motor 691 at a predetermined revolution speed ω1 and a predetermined designated number of pulses N1, the tube 616 is pressed and stroked by the pump roller 614, thereby allowing the negative pressure in the cap 621 to reach a first target value negative pressure P1 at predetermined time t1 (step S91). For example, in an environment where a temperature is equal to 30° C. and a humidity is equal to 80%, the predetermined time is equal to about 0.5 second and the target negative pressure is equal to about 0.12 kgf/cm$^2$. Thus, the negative pressure acts on the recording head 7 through the joint tube 626 and the cap 621 and the ink, bubbles, or the like which is not suitable for recording is started to be forcedly sucked from the discharge port of the recording head 7.

It is sufficient to set the first target negative pressure P1 to a negative pressure enough to allow the ink which is not suitable for recording to flow from the discharge port of the recording head 7. There is no need to set pressure P1 to a high negative pressure at which all bubbles in the discharge port flow. Further, after the normal rotation driving of the recovery motor 691 corresponding to only the number of pulses N1 is finished, the recovery motor 691 is stopped for preset predetermined time Δt12, for example, 500 msec (step S92). During the stop of the recovery motor 691, if the ink sucked from the discharge port of the recording head 7 by the negative pressure in the cap 621 flows into the tube 616, since the recovery motor 691 is stopped, the negative pressure in the cap 621 drops by a value corresponding to a volume of the inflow ink, that is, ΔP12, for example, about 0.1 kgf/cm$^2$.

When the standby mode of the predetermined time Δt12 is finished, the normal rotation driving of the recovery motor 691 is started and the recovery motor 691 is normally rotated at the predetermined revolution speed ω1 and a predetermined designated number of pulses N2 (step S93). By the redriving of the recovery motor 691, the negative pressure is again raised by almost the same value as the drop amount ΔP12. That is, the negative pressure again rises toward the first target negative pressure P1 in the first suction step. As mentioned above, in the first suction step, by repeating the stop and the driving of the recovery motor 691, the negative pressure in the cap 621 can be maintained at a value near the target negative pressure P1. A reference character "n" in FIG. 16 denotes the number of repetition times of the stop (step S92) and redriving (step S93) of the recovery motor 691. Whether or not the number of repetition times (n) of the stop (step S92) and redriving (step S93) of the recovery motor 691 has reached a preset predetermined value nc, for example, 4 times is discriminated (step S94). The above processes are repeated until the number of repetition times (n) is equal to or larger than nc (n≧nc).

When the number of repetition times (n) reaches the predetermined value nc, the recovery motor 691 is again stopped for preset predetermined time Δt34, for example, about 2.0 sec (step S95). During the stop of the recovery motor 691, the negative pressure in the cap 621 drops by a value of ΔP13, for example, about 0.5 kgf/cm$^2$ and becomes P3, for example, about 0.7 kgf/cm$^2$. At a point of time when the standby time Δt34 elapses, about 80% to about 90% of the ink which is not suitable for recording is sucked from the recording head 7 by the pump unit 61. However, in many cases, the bubbles in the discharge port of the recording head 7, particularly, the bubbles just under the discharge port are not sucked but remain. After the standby mode of the predetermined time Δt34 is finished, the recovery motor 691 is normally rotated at the predetermined revolution speed ω1 and a predetermined designated number of pulses N3 (step S96). The negative pressure in the cap 621 is allowed to reach a second target negative pressure P4, for example, about 1.7 kgf/cm$^2$ in predetermined time Δt45, for example, about 0.5 sec. An absolute value of the second target negative pressure P4 in the second suction step is larger than that of the first target negative pressure P1 in the first suction step. The negative pressure P4 is a negative pressure necessary for sucking the bubbles in the discharge port of the recording head 7, particularly, the bubbles near the discharge port at a stretch.

Further, when the normal rotation driving of the recovery motor 691 corresponding to the number of pulses N3 is finished, the recovery motor 691 is stopped for preset predetermined time Δt56, for example, about 1.0 sec (step S97). After the predetermined time Δt56 is finished, by opening the valve 64 by the rotation of the cam 65 (step S98 in FIG. 16 and step S10 in FIG. 15), the negative pressure in the cap 621 is dropped down to the atmospheric pressure.

The negative pressure increase ΔP34 from the negative pressure P3 in the cap 621 to the second target negative pressure P4 and in the subsequent release of the negative pressure to the atmospheric pressure by the opening of the valve 64, the increase in negative pressure and the decrease in negative pressure are executed in a pulse-like manner when seen from the whole suction operation, thereby sucking the bubbles in the discharge port of the recording head 7, particularly, the bubbles near the discharge port at a stretch. For example, even if the suction is continued at the first target negative pressure P1, it is almost impossible to suck the bubbles in the discharge port of the recording head 7, particularly, all of the bubbles near the discharge port. If the suction is continued at the second target negative pressure P4, the ink flow rate from the discharge port of the recording head 7 increases and exceeds the maximum ink flow rate from an ink tank 71. Therefore, there is a case where the bubbles instead of the ink are fetched from the ink supply port, so that the bubbles in the discharge port of the recording head 7 increase on the contrary.

On the other hand, by combining the suction (first suction step) according to the first target negative pressure P1 and the suction (second suction step) according to the second target negative pressure P4 which is executed in a pulse-like manner, the ink which is not suitable for recording, the bubbles, or the like in the discharge port can be effectively sucked from the discharge port of the recording head 7. If the bubbles or the like in the discharge port cannot be sucked even by the suction according to the first target negative pressure P1 and the suction according to the second target negative pressure P4 which is executed in a pulse-like manner, it is also possible to repeat only the suction (second suction step) according to the second target negative pressure P4 which is executed in a pulse-like manner. By this method, the bubbles in the discharge port can be effectively sucked and removed without wastefully consuming the ink. The above suction recovery operation is effective particularly in the suction recovery operation in the case where a large amount of bubbles were inserted into the discharge port of the recording head 7, particularly, the region near the discharge port due to an exchange of the ink tank 71, misattachment of the ink tank 71, or the like. As mentioned above, according to the embodiment, there is provided the suction recovery method of the ink jet recording apparatus in which the suction recovery performance can be improved without enlarging the size of apparatus and a number of discharge ports can be held in the good state.

Embodiment 2

Figure 18:
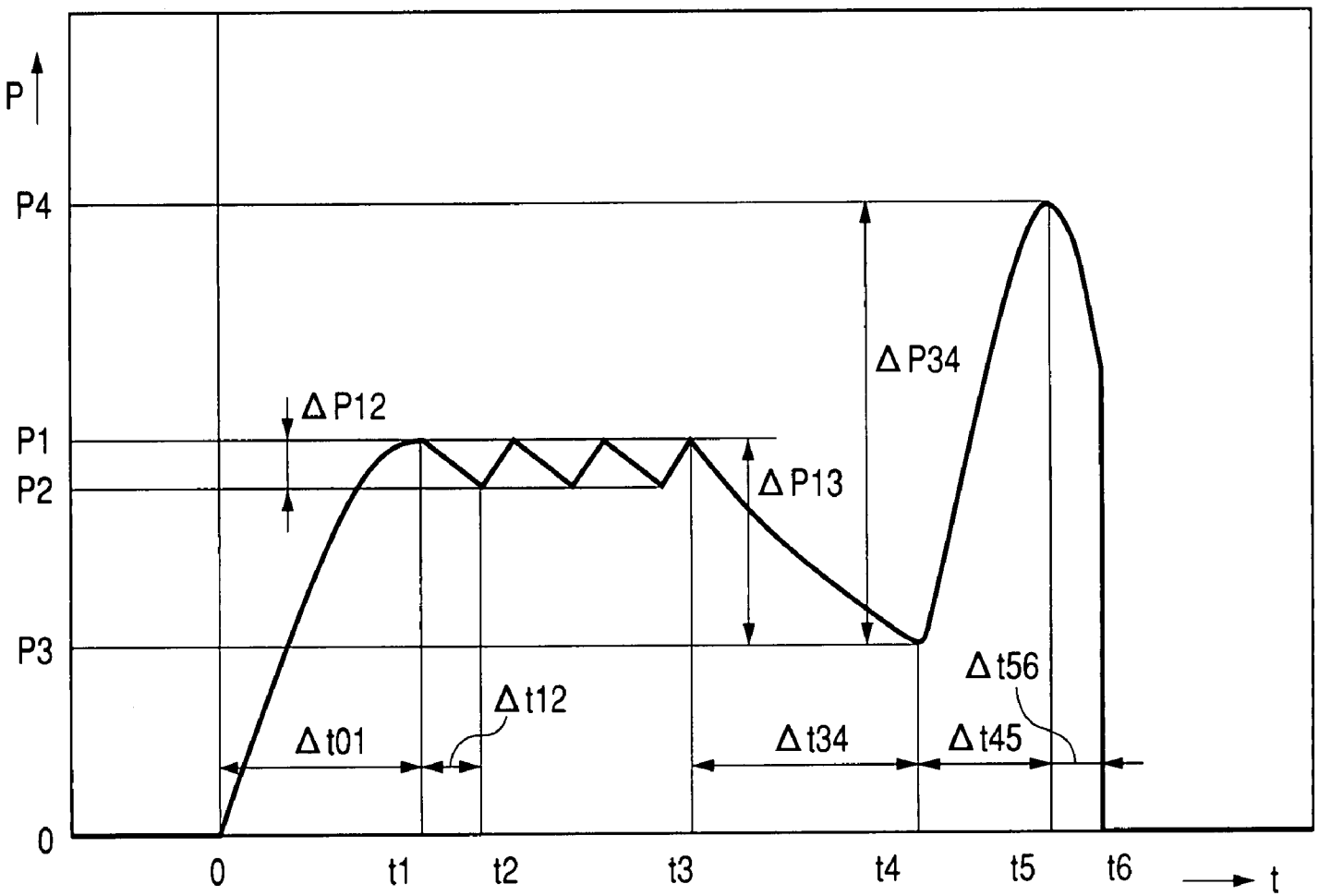
FIG. 18 is a graph showing a fluctuation state of a negative pressure due to the suction operation according to an embodiment 2.

FIG. 18 is a graph showing a fluctuation state of a negative pressure due to the suction operation according to an embodiment 2. In FIG. 18, in order to allow the negative pressure in the cap 621 to reach the first target negative pressure P1, the recovery motor 691 is normally rotated at the predetermined revolution speed ω1 and the designated number of pulses N1. After the negative pressure reaches the first target negative pressure P1, the stop and redriving of the recovery motor 691 are repeated. After the stop and redriving are repetitively executed a predetermined number of times, the recovery motor 691 is stopped for the predetermined time Δt34 and the negative pressure in the cap 621 is dropped from P1 to P3. Subsequently, in order to allow the negative pressure to reach the second target negative pressure P4, the recovery motor 691 is normally rotated at a revolution speed ω2 higher than ω1 and the designated number of pulses N3. Other construction of the embodiment 2 is substantially the same as that in the case of the foregoing embodiment 1.

According to the embodiment 2, since the revolution speed ω2 is higher than the revolution speed ω1, arrival time Δt45 which is required until the second target negative pressure P4 is obtained in the second suction step is higher (short time) than arrival time t01 which is required until the first target value negative pressure P1 is obtained in the first suction step and a suction energy to suck the bubbles from the discharge port of the recording head 7 increases. Therefore, the bubbles in the discharge port of the recording head 7 can be more easily and effectively absorbed as compared with the foregoing embodiment 1.

Embodiment 3

Figure 19:
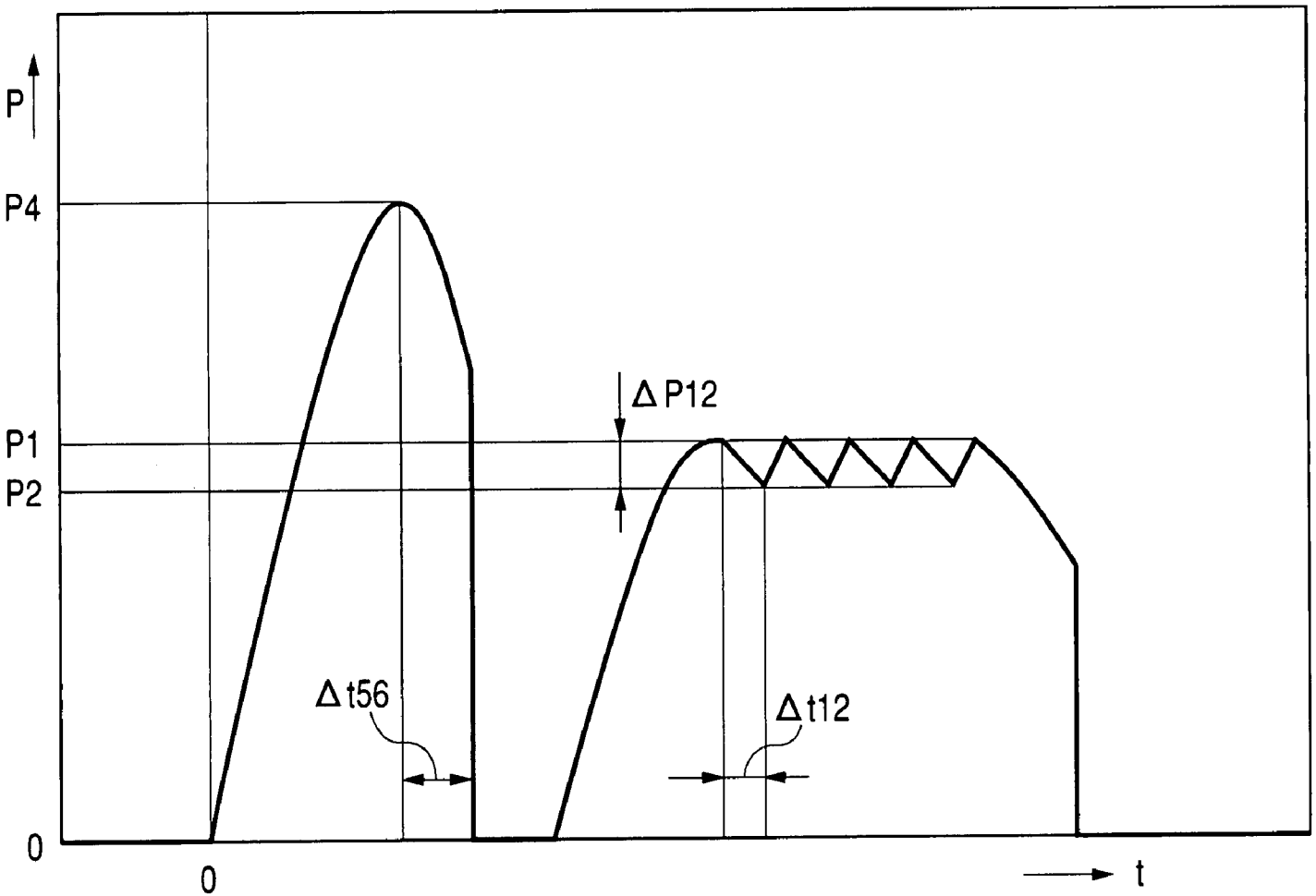
FIG. 19 is a graph showing a fluctuation state of a negative pressure due to the suction operation according to an embodiment 3.

FIG. 19 is a graph showing a fluctuation state of a negative pressure due to the suction operation according to an embodiment 3. In FIG. 19, first, in the first suction step, by normally rotating the recovery motor 691 at the predetermined revolution speed ω1 and the predetermined designated number of pulses N1, the negative pressure in the cap 621 is allowed to reach the first target negative pressure P4. At this time, the first target value negative pressure P4 is larger than the second target value negative pressure P1 in the second suction step, which will be explained hereinafter, and is a negative pressure necessary for sucking the bubbles, particularly, near the discharge port of the recording head 7 at a stretch. Further, when the normal rotation of the recovery motor 691 of the number of pulses N1 is finished, the recovery motor 691 is stopped for preset predetermined time Δt56. At this time, the ink containing the bubbles just under the discharge port of the recording head 7 flows into the tube 616.

At this time, although the valve 64 is left closed, if the predetermined time Δt56 is long, the flow speed of the ink from the discharge port of the recording head 7 rises and exceeds the maximum ink flow rate from the ink tank 71. Therefore, the bubbles instead of the ink are fetched from the ink supply port and the bubbles in the discharge port of the recording head 7 increase on the contrary. To prevent such a situation, the predetermined time Δt56 is set to as a short time as possible. After the elapse of the predetermined time Δt56, the recovery motor 691 is reversibly rotated, the valve 64 is opened, and the negative pressure in the cap 621 is released to the atmospheric pressure. Further, the recovery motor 691 is reversibly rotated and the valve 64 is closed again. After that, the recovery motor 691 is normally rotated and the suction is restarted. After the restart of the suction, the negative pressure reaches the second target negative pressure P1. After the negative pressure reaches the second target negative pressure P1, the stop and redriving of the recovery motor 691 are repeated. After the stop and redriving are repetitively executed a predetermined number of times, the recovery motor 691 is stopped and the valve 64 is opened by the rotation of the cam 65, thereby dropping the negative pressure in the cap 621 from P1 to the atmospheric pressure.

By the above processes, the suction operation is finished. Although a common liquid chamber (not shown) of the recording head 7 is filled with the ink of about 80% to about 90%, the foregoing suction recovery operation is particularly effective in the case where an amount of bubbles near the discharge port of the recording head 7 is large. In this instance, a consumption amount of the ink can be reduced by shortening the suction operation time after the negative pressure reaches the second target negative pressure P1.

Other construction of the embodiment 3 is substantially the same as that in the case of the foregoing embodiment 1 or 2.

Embodiment 4

Figure 20:
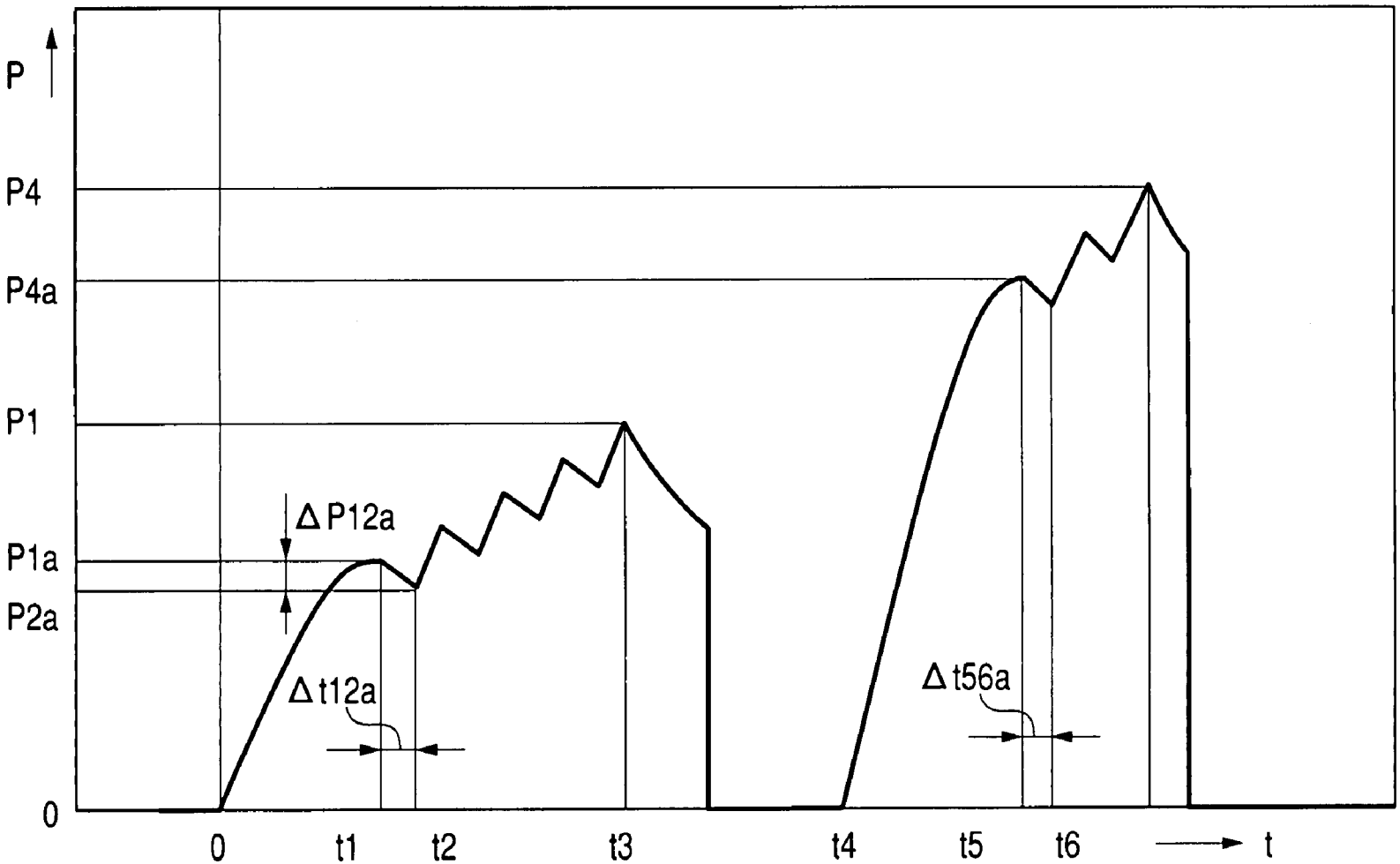
FIG. 20 is a graph showing a fluctuation state of a negative pressure due to the suction operation according to an embodiment 4.
Figure 21:
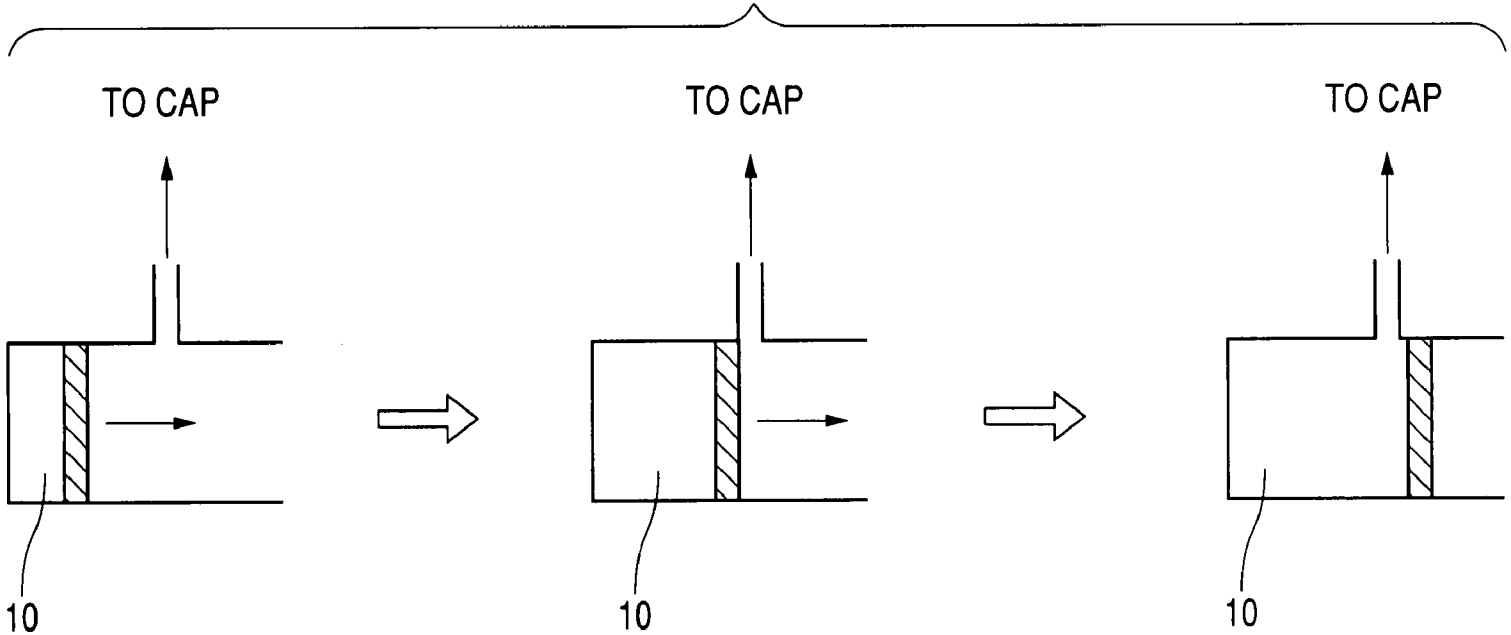
FIG. 21 is an explanatory diagram showing a principle of a piston pump.
Figure 22:
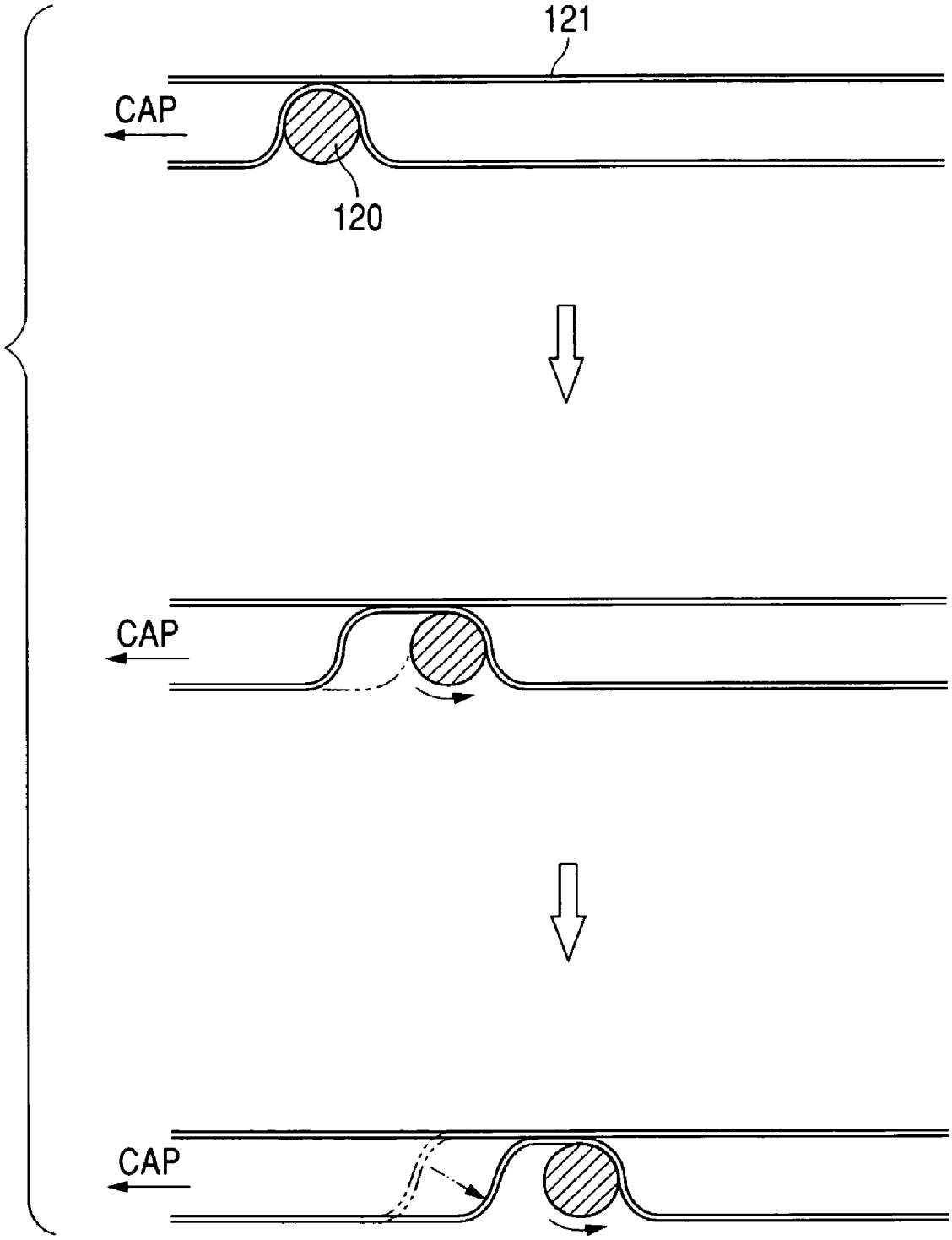
FIG. 22 is an explanatory diagram showing a principle of a tube pump.
Figure 23:
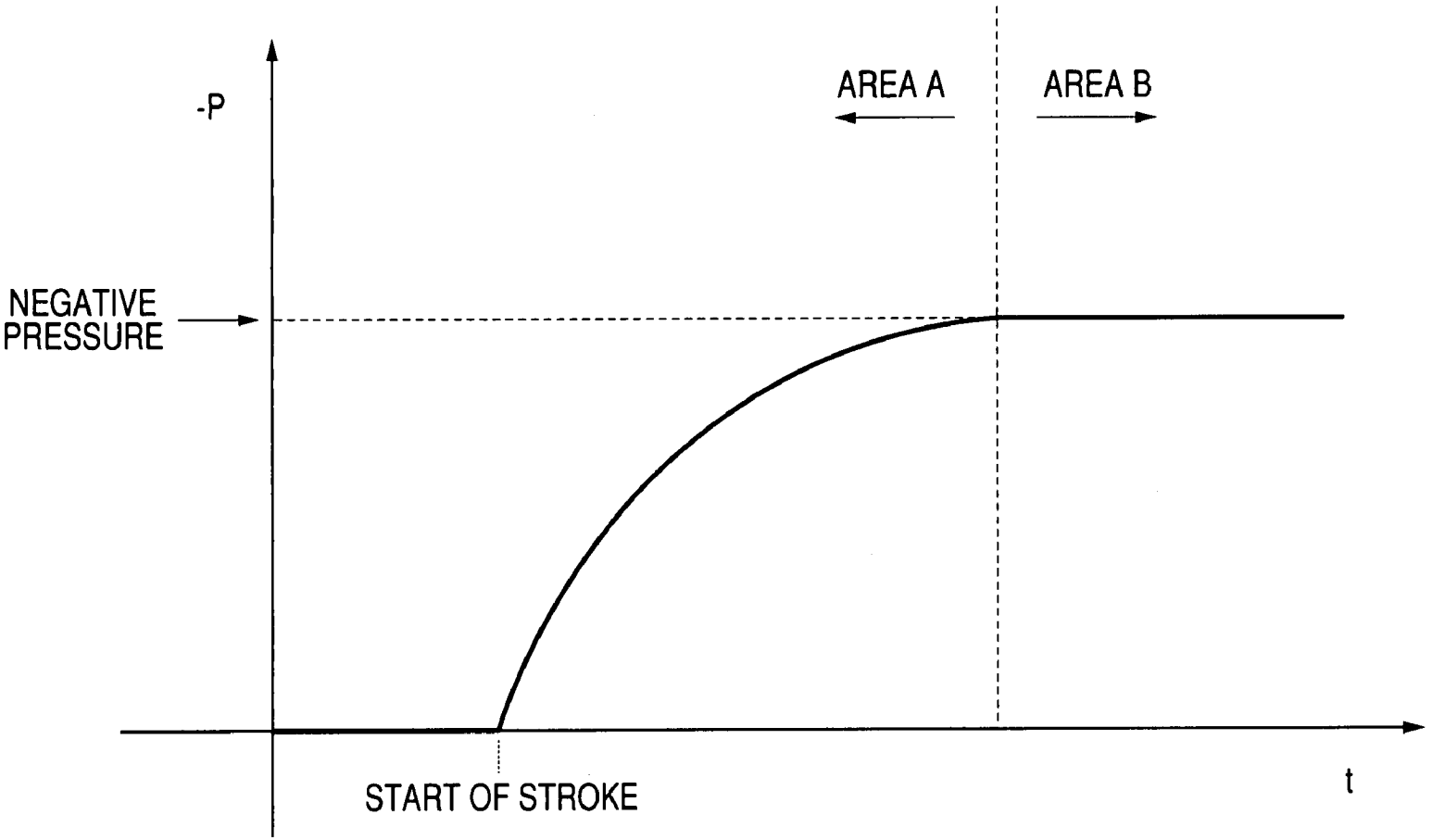
FIG. 23 is a graph showing a negative pressure curve at the time of the suction operation in the tube pump.

FIG. 20 is a graph showing a fluctuation state of a negative pressure due to the suction operation according to an embodiment 4. In FIG. 20, first, by normally rotating the recovery motor 691 at the predetermined revolution speed ω1 and the predetermined designated number of pulses N1, the negative pressure in the cap 621 is allowed to reach P1*a* smaller than the first target negative pressure P1. After that, the recovery motor 691 is stopped for predetermined stop time Δt12*a* and, further, the recovery motor 691 is normally rotated at the predetermined number of pulses N2. By further repeating the stop and redriving of the recovery motor 691, the negative pressure in the cap 621 is allowed to reach the first target negative pressure P1 step by step. It is sufficient to set the first target negative pressure P1 in the first suction step to a negative pressure enough to allow the ink which is not suitable for recording to flow from the discharge port of the recording head 7. There is no need to set the first target value negative pressure P1 to a high negative pressure for allowing all of the bubbles in the discharge port to flow.

Subsequently, the recovery motor 691 is reversibly rotated, the valve 64 is opened, and the negative pressure in the cap 621 is released to the atmospheric pressure. After that, the recovery motor 691 is reversibly rotated and the valve 64 is closed again. Subsequently, the recovery motor 691 is normally rotated and the suction is restarted. After the restart of the suction, the negative pressure is allowed to reach P4*a* smaller than the second target negative pressure P4. After that, the recovery motor 691 is stopped for predetermined stop time Δt56*a* and, further, the recovery motor 691 is normally rotated at a predetermined number of pulses N4. By further repeating the stop and redriving of the recovery motor 691, the negative pressure in the cap 621 is allowed to reach the second target negative pressure P4 step by step. After the second suction step is executed, the recovery motor 691 is reversibly rotated, the valve 64 is opened by the rotation of the cam 65, thereby dropping the negative pressure in the cap 621 to the atmospheric pressure. The suction operation is finished. The foregoing suction recovery operation is particularly effective in the suction recovery operation in the case where a large quantity of bubbles entered the region in the discharge port of the recording head 7, particularly, the region just under the discharge port due to an exchange of the ink tank 71, misattachment of the ink tank 71, or the like.

As will be obviously understood from the above explanation, according to each of the foregoing embodiments, there is provided the suction recovery method of the ink jet recording apparatus in which the suction recovery performance can be improved without enlarging the size of apparatus and a number of discharge ports can be held in the good state. That is, according to the above embodiments 1 to 4, in the suction recovery method of the ink jet recording apparatus in which by making the suction means connected to the cap operative in the state where the discharge ports of the recording head are closed by the cap, the negative pressure is generated in the cap, and the ink is sucked from the discharge ports, the suction recovery method comprises: the first suction step of sucking the inside of the cap 621 at the first target negative pressure P1 (or P4) by the suction means 61; and the second suction step of sucking the inside of the cap 621 at the second target negative pressure P4 (or P1) by the suction means 61. According to such a construction, the two functions comprising the function for ejecting the ink which is not suitable for recording from the recording head 7 and supplying the ink from the ink tank and the function for sucking and removing the bubbles in the discharge port (particularly, near the discharge port) of the recording head 7 are separated and the target negative pressure that is optimized to each function (suction step) can be set, so that there is provided the suction recovery method of the ink jet recording apparatus in which the suction recovery performance can be improved without enlarging the size of apparatus and a number of discharge ports can be held in the good state.

According to each of the foregoing embodiments, since the suction means 61 is the tube pump, the target negative pressure can be arbitrarily set by the control upon operation, the two functions comprising the function for ejecting the ink which is not suitable for recording from the recording head 7 and supplying the ink from the ink tank and the function for sucking and removing the bubbles in the discharge port (particularly, just under the discharge port) of the recording head 7 are separated and the target negative pressure that is optimum to each function can be set, so that there is provided the suction recovery method of the ink jet recording apparatus in which the suction recovery performance can be improved without enlarging the size of apparatus and a number of discharge ports can be held in the good state. Further, according to each of the foregoing embodiments, since the recording head 7 has an electrothermal converting element for generating a heat energy which caused film boiling in the ink as an element for generating an energy that is used for discharging the ink, there is provided the suction recovery method of the ink jet recording apparatus in which the discharge ports of the recording head 7 can be installed at a high density without deteriorating the suction recovery performance and a number of discharge ports can be held in the good state without enlarging the size of apparatus.

Although the above embodiments have been described with respect to the case of the discharge recovery device having two pump tubes 616 as an example, the invention can be similarly applied to the case of the discharge recovery device having one pump tube or three or more pump tubes and similar operations and effects are obtained. Those examples are also incorporated in the scope of the invention. Although the above embodiments have been described with respect to the ink jet recording apparatus of the serial recording system, as an example, in which the recording is performed while relatively moving the recording means 7 for the recording medium, the invention can be also similarly applied to an ink jet recording apparatus of the line recording system in which the recording is performed only by the sub scanning by using recording means of a line type having a length which covers the whole or a part of the width of the recording medium and similar effects can be accomplished. Further, the invention can be also similarly applied to the case of a recording apparatus using one recording means, a color recording apparatus using a plurality of recording means for recording with ink of different colors, a gradation recording apparatus using a plurality of recording means for recording at different concentrations of the same color, or a hybrid recording apparatus in which those apparatuses are combined, and similar effects can be accomplished.

Moreover, the invention can be also similarly applied to the case of any layout construction of the recording head and the ink tanks such as construction using exchangeable ink cartridges in each of which the recording head and the ink tank are integrated, construction in which the recording head and the ink tanks are separately arranged and they are connected by ink supplying tubes or the like, or the like, and similar effects are also obtained. Although the invention can be applied to the case where the ink jet recording apparatus uses recording means using an electromechanical transducer such as a piezoelectric element or the like, an excellent effect is obtained where the ink jet recording apparatus uses recording means of a system in which the ink is emitted by using thermal energy among those apparatuses. This is because according to such a system, high density and high precision of recording can be accomplished.

This application claims priority from Japanese Patent Application No. 2003-296394 filed on Aug. 20, 2003, which is hereby incorporated by reference herein.

What is claimed is:

1. An ink jet recording apparatus comprising:

a cap for covering discharge ports of a recording head; and a pump which is connected to said cap and generates a negative pressure in said cap, wherein said pump sucks the inside of said cap at a first negative pressure for a first period of time, and thereafter sucks the inside of said cap at a second negative pressure, whose absolute value is greater than that of the first negative pressure, for a second period of time shorter than the first period of time.

2. An apparatus according to claim 1, wherein an arrival time which is required until the second negative pressure is obtained is shorter than an arrival time which is required until the first negative pressure is obtained.

3. An apparatus according to claim 1, wherein after the inside of said cap is sucked at the first negative pressure, said pump is stopped and the absolute value of the negative pressure in said cap is reduced.

4. An apparatus according to claim 1, wherein after the inside of said cap is sucked at the first negative pressure, the inside of said cap is released to the atmosphere.

5. An apparatus according to claim 1, wherein said pump is a tube pump.

6. An apparatus according to claim 1, wherein the recording head comprises an electrothermal converting element for generating heat energy which causes film boiling in ink for discharging the ink.

7. A recovery method of an ink jet recording apparatus, comprising the steps of:

arranging a cap for covering discharge ports of a recording head;

arranging a pump which is connected to the cap and generates a negative pressure in the cap;

sucking the inside of the cap at a first negative pressure for a first period of time, by means of the cap; and then sucking the inside of the cap at a second negative pressure whose absolute value is greater than that of the first negative pressure, for a second period of time shorter than the first period of time, by means of the cap.

8. A method according to claim 7, wherein an arrival time which is required until the second negative pressure is obtained is shorter than an arrival time which is required until the first negative pressure is obtained.

9. A method according to claim 7, further comprising the step of sucking the inside of the cap at the first negative pressure, thereafter, stopping the pump, and reducing the absolute value of the negative pressure in the cap.

10. A method according to claim 7, further comprising the step of sucking the inside of the cap at the first negative pressure and, thereafter, releasing the inside of the cap to the atmosphere.

11. A method according to claim 7, wherein the pump is a tube pump.

12. A method according to claim 7, wherein the recording head comprises an electrothermal converting element for generating heat energy which causes film boiling in ink for discharging the ink.

* * * * *

UNITED STATES PATENT AND TRADEMARK OFFICE

CERTIFICATE OF CORRECTION

PATENT NO. : 7,128,390 B2
APPLICATION NO. : 10/914241
DATED : October 31, 2006
INVENTOR(S) : Taniguchi It is certified that error appears in the above-identified patent and that said Letters Patent is hereby corrected as shown below:

In the Specifications:

COLUMN 2:
Line 31, “toga” should read --to a--.

COLUMN 7:
Line 38, “maimer” should read --manner--.

COLUMN 8:
Line 29, “be” should be deleted.
Line 43, “pipe line” should read --pipeline--.
Line 47, “pipe line” should read --pipeline--.

COLUMN 11:
Line 4, “the,opening/closing” should read --the opening/closing--.

COLUMN 14:
Line 42, “a” (second occurrence) should be deleted.
Line 43, --a-- should be inserted before “time”.

COLUMN 17:
Line 4, “or the like” (first occurrence) should be deleted.

Signed and Sealed this
Fourteenth Day of May, 2013

Teresa Stanek Rea
*Acting Director of the United States Patent and Trademark Office*